US008628356B2

(12) United States Patent
Laurx et al.

(10) Patent No.: US 8,628,356 B2
(45) Date of Patent: Jan. 14, 2014

(54) RIGHT ANGLE ADAPTOR

(75) Inventors: John C. Laurx, Aurora, IL (US); Peerouz Amleshi, Lisle, IL (US); Brian Hauge, Lisle, IL (US)

(73) Assignee: Molex Incorporated, Lisle, IL (US)

( * ) Notice: Subject to any disclaimer, the term of this patent is extended or adjusted under 35 U.S.C. 154(b) by 10 days.

(21) Appl. No.: 13/503,516

(22) PCT Filed: Oct. 22, 2010

(86) PCT No.: PCT/US2010/053770

§ 371 (c)(1), (2), (4) Date: Jul. 2, 2012

(87) PCT Pub. No.: WO2011/050277

PCT Pub. Date: Apr. 28, 2011

(65) Prior Publication Data

US 2012/0264334 A1 Oct. 18, 2012

Related U.S. Application Data

(60) Provisional application No. 61/297,635, filed on Jan. 22, 2010, provisional application No. 61/254,320, filed on Oct. 23, 2009.

(51) Int. Cl.
*H01R 31/06* (2006.01)

(52) U.S. Cl.
USPC ..... 439/628

(58) Field of Classification Search
USPC ..... 439/626, 607.05, 61, 798
See application file for complete search history.

(56) References Cited

U.S. PATENT DOCUMENTS

| | | | | |
|---|---|---|---|---|
| 6,540,522 | B2 * | 4/2003 | Sipe | 439/61 |
| 6,851,980 | B2 * | 2/2005 | Nelson et al. | 439/607.05 |
| 7,331,801 | B1 * | 2/2008 | Eichorn | 439/79 |
| 7,540,744 | B1 | 6/2009 | Minich | |
| 2002/0160658 | A1 | 10/2002 | Sipe | |
| 2002/0192988 | A1 * | 12/2002 | Droesbeke et al. | 439/79 |
| 2003/0124910 | A1 * | 7/2003 | Nelson et al. | 439/608 |
| 2005/0239332 | A1 * | 10/2005 | Maegawa et al. | 439/628 |
| 2006/0276081 | A1 | 12/2006 | Cohen et al. | |
| 2008/0280494 | A1 * | 11/2008 | Martich | 439/628 |
| 2009/0203261 | A1 * | 8/2009 | Ikegami et al. | 439/628 |

FOREIGN PATENT DOCUMENTS

KR 2008-0012189 A 2/2008

OTHER PUBLICATIONS

International Search Report for PCT/US2010/053770.

* cited by examiner

*Primary Examiner* — Chandrika Prasad
(74) *Attorney, Agent, or Firm* — Stephen L. Sheldon

(57) ABSTRACT

An adaptor includes a first and second recess that face in opposing directions and that are configured to receive a first and second connector. A floor in the adaptor can separate the first recess from the second recess. A pin array can be positioned in the floor and the pin array can extend in two directions from the floor so as to extend into the first and second recess. The pin array can include terminals that are configured with first and second contact ends that are respectively positioned in the first and second recess. The first and second contact ends can be respectively configured with a first and second orientation that are at a right angle with respect to each other.

10 Claims, 33 Drawing Sheets

RIGHT ANGLE ADAPTOR

BACKGROUND OF THE INVENTION

1. Field of the Invention

The present invention relates to the field of connectors, more specifically to the field of backplane related connectors.

2. Description of Related Art

Backplane connectors are known. They are typically used to couple two separate boards (e.g., between a communication board and a processor board) so as to enable high speed communication between different portions of a computing system. In general, backplane connectors tend to offer dense pin fields and are configured for high data rates. For example, recent backplane designs have allowed data rates that are greater than 10 Gbps and new designs are intended to allow data rates of 20 Gbps or more.

Typically backplane connectors are provided in what is known as a mezzanine configuration or an orthogonal configuration. Mezzanine connectors are used to couple together two boards that are parallel while orthogonal connectors couple boards that are positioned at right angles (e.g., boards that are orthogonal to each other). Due to system configurations, sometimes a mid-plane design is also used to couple together two connector configurations on opposite sides of the mid-plane. For example, a mid-plane board could couple together two orthogonal connectors. Existing mid-plane designs, however, create problems as the data rates increase. Thus certain individuals would appreciate an improved connector system suitable for high data rates.

BRIEF SUMMARY OF THE INVENTION

An adaptor is configured to couple a first connector to a second connector while providing an angle change between the first and second connector. The adaptor includes a first and second recess that face in opposing directions and that are configured to receive the first and second connector. A floor can be provided in the adaptor to separate the first recess from the second recess. A pin array can be positioned in the floor and the pin array can extend in two directions from the floor so as to extend into the first and second recess. The pin array includes signal terminals and ground terminals. The signal terminals can be arranged in pairs so as to provide a differential signal channel. The signal terminals are configured with first and second contact ends that are respectively positioned in the first and second recess. The first and second contact ends can be respectively configured with a first and second orientation that are at a right angle with respect to each other. Therefore, a differential pair can have first contacts in a first line and second contacts can be in a second line that is at a right angle with respect to the first line. A body portion of the signal contacts can be configured to provide a transition between the first contact end and the second contact end. The body portion can also include a feature to engage the floor. Ground terminals can also be configured to provide first contacts in a first orientation and second contacts in a second orientation with the first and second orientation 90 degrees apart. To improve electrical performance of the first connector, a ground member can be inserted into the floor. The ground member can be configured to engage multiple ground terminals so as to common the ground terminals with respect to each other. In an embodiment, the adaptor can be configured to so that the first recess includes a first and second pin array. The first pin array may be configured as discussed above and the second pin array can include terminals that are configured with contact ends in the first recess and tails that extend out of the floor but are configured to engage vias in a mid-plane.

BRIEF DESCRIPTION OF THE DRAWINGS

The present invention is illustrated by way of example and not limited in the accompanying figures in which like reference numerals indicate similar elements and in which.

DESCRIPTION OF THE INVENTION

Figure 1:
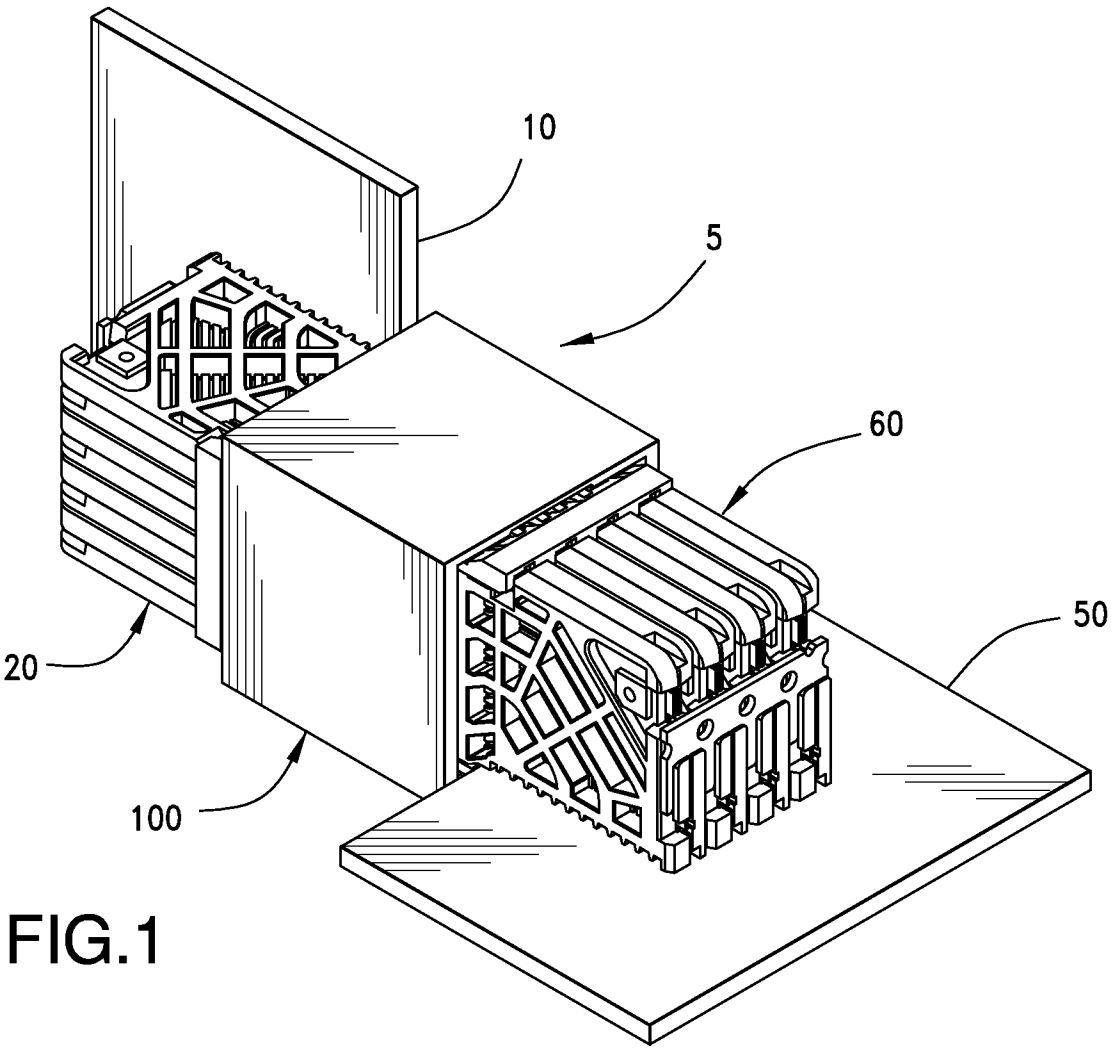
FIG. 1 illustrates a perspective view of an embodiment of a connector system with an adaptor.
Figure 2:
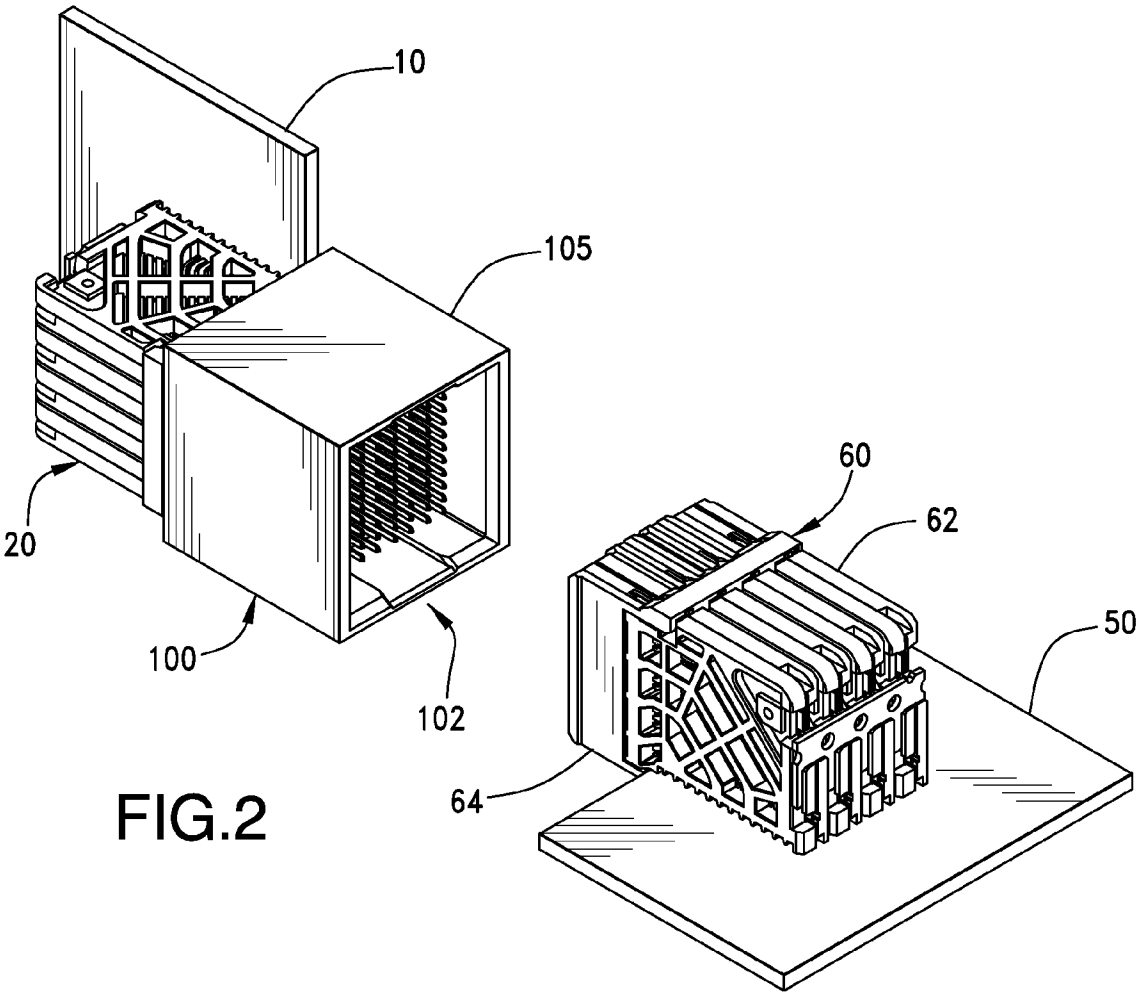
FIG. 2 illustrates a partially exploded perspective view of the connector system depicted in FIG. 1.
Figure 3:
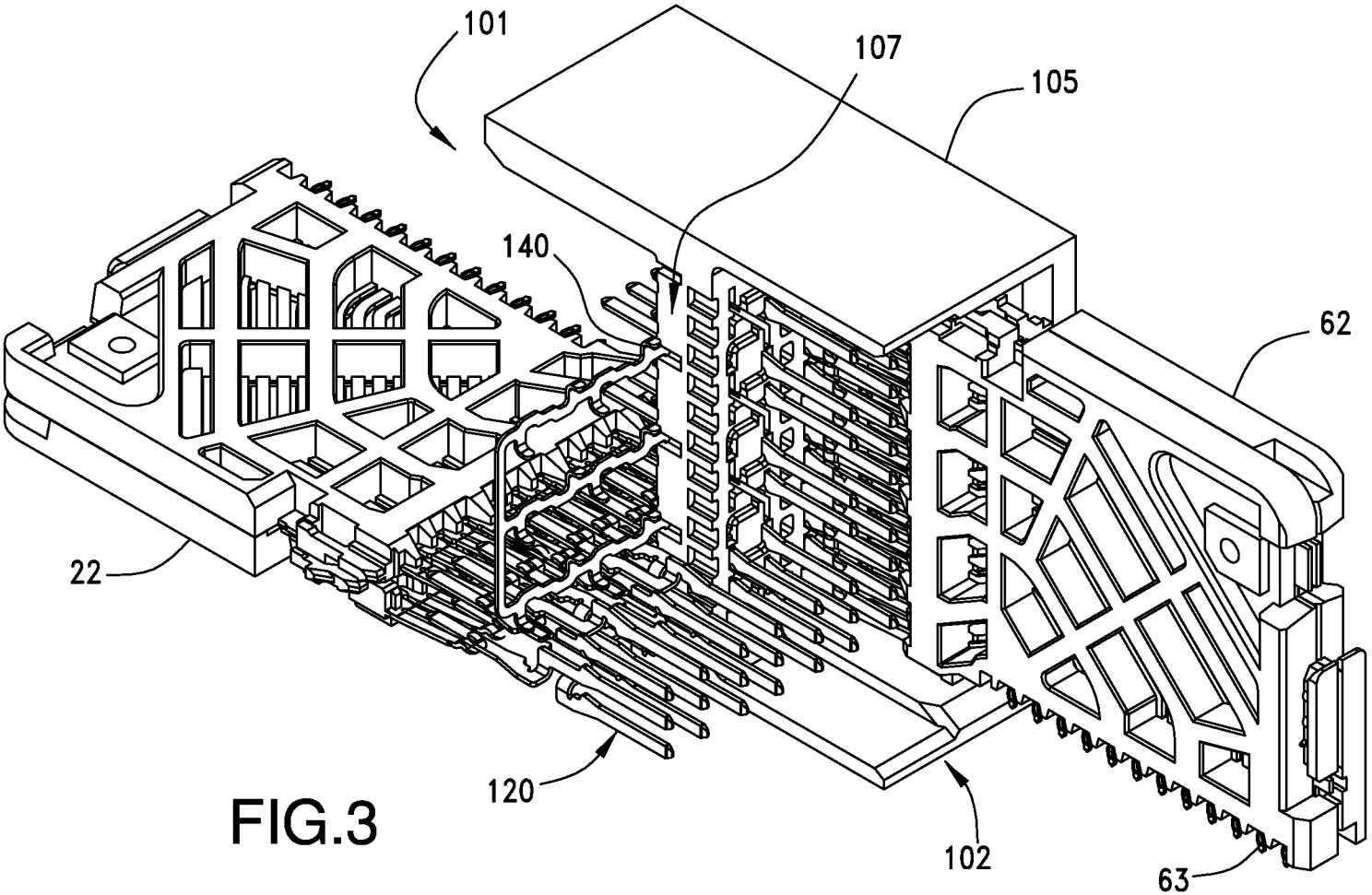
FIG. 3 illustrates a partial, cut-away perspective view of the connector system depicted in FIG. 1.
Figure 4:
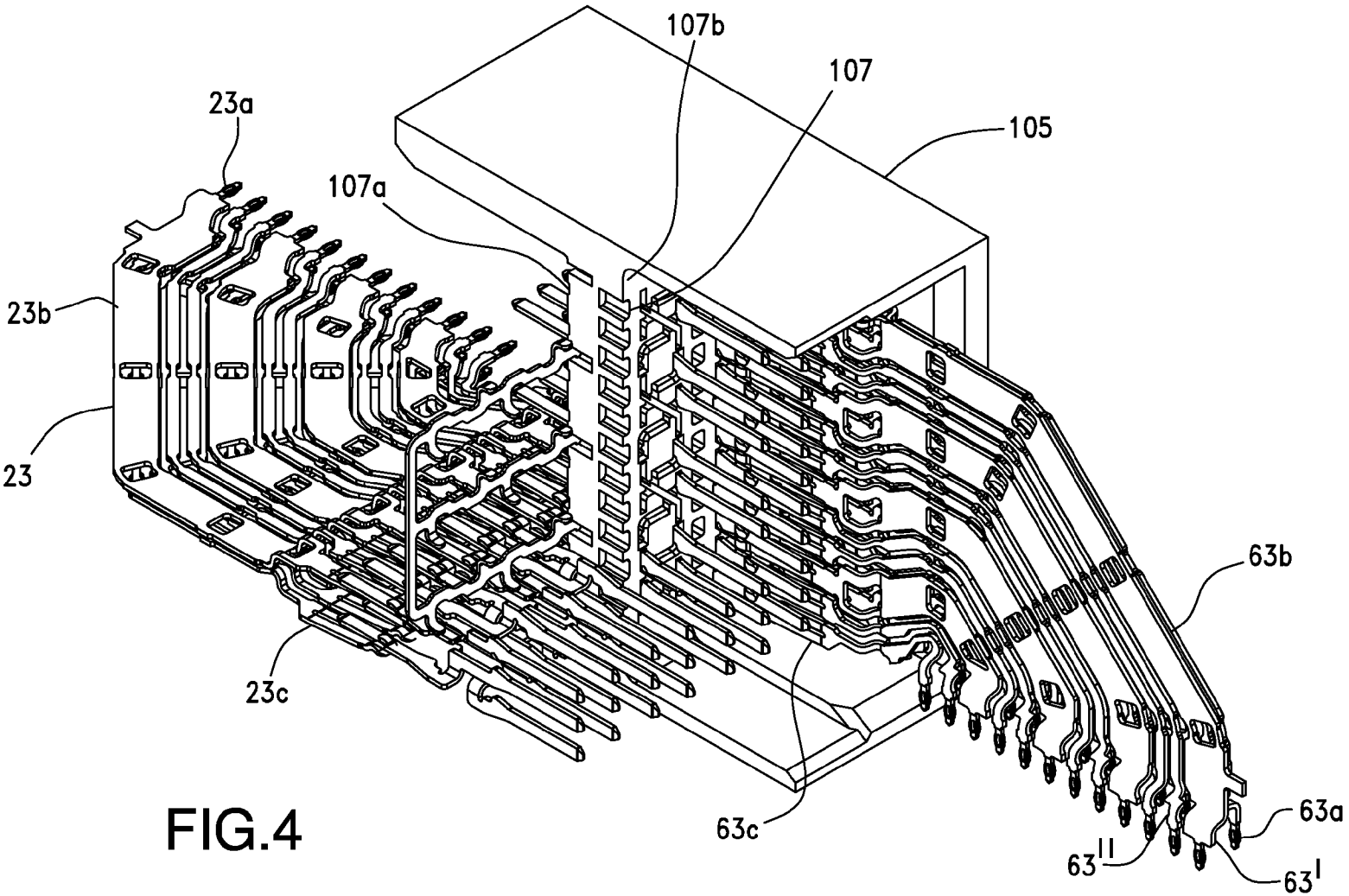
FIG. 4 illustrates a further simplified perspective view of the connector system depicted in FIG. 3.
Figure 5:
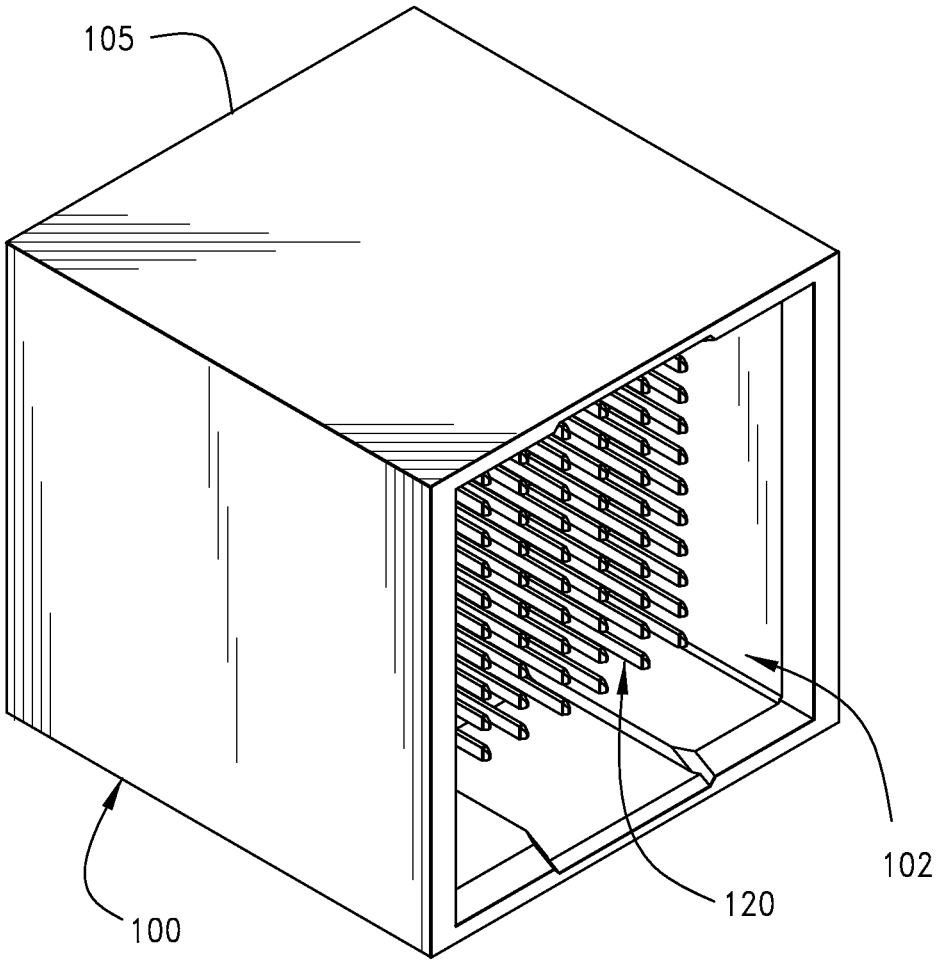
FIG. 5 illustrates a perspective view of an embodiment of an adaptor connector.
Figure 6:
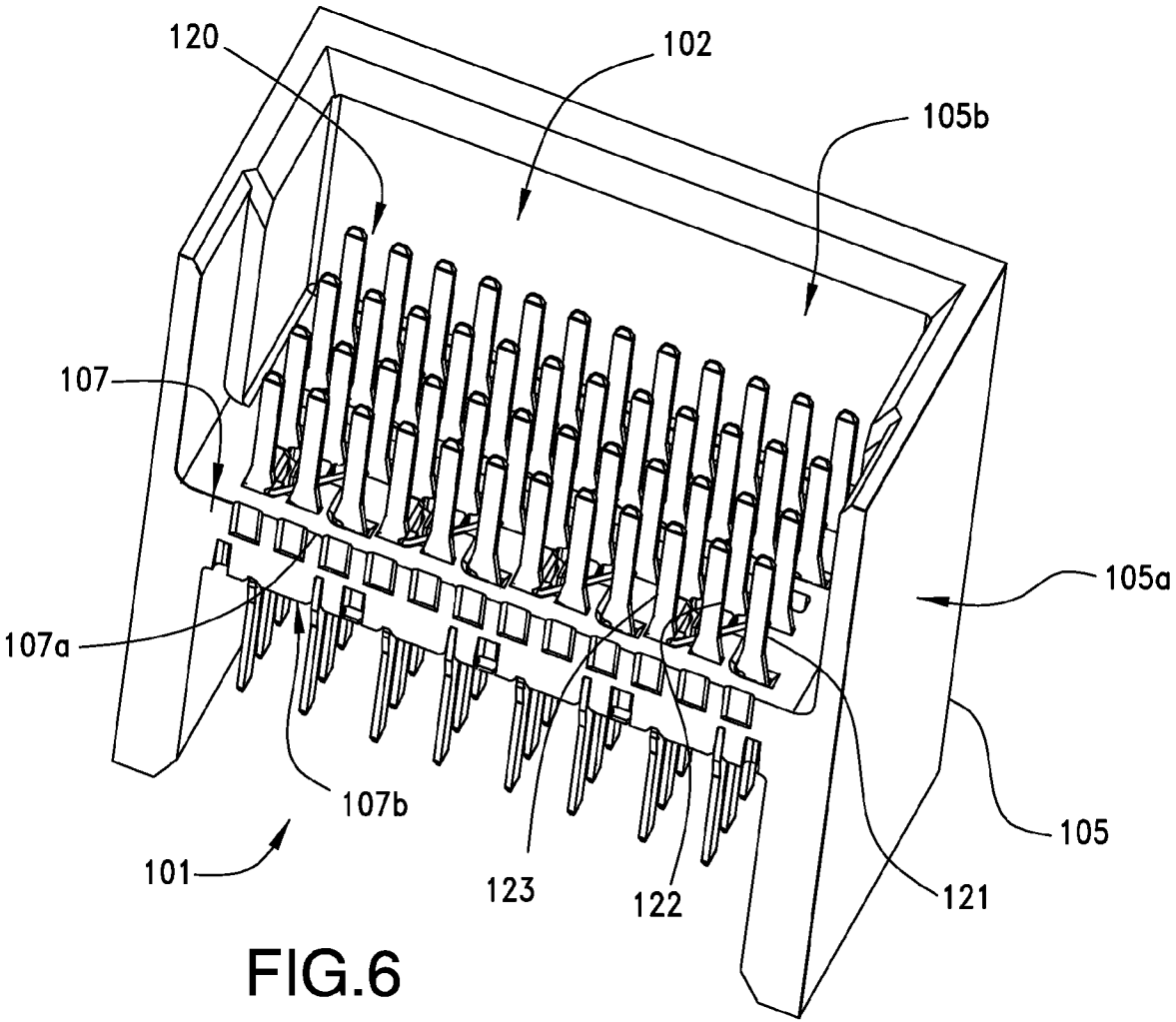
FIG. 6 illustrates a perspective view of a cross-section of the adaptor connector depicted in FIG. 5.
Figure 7:
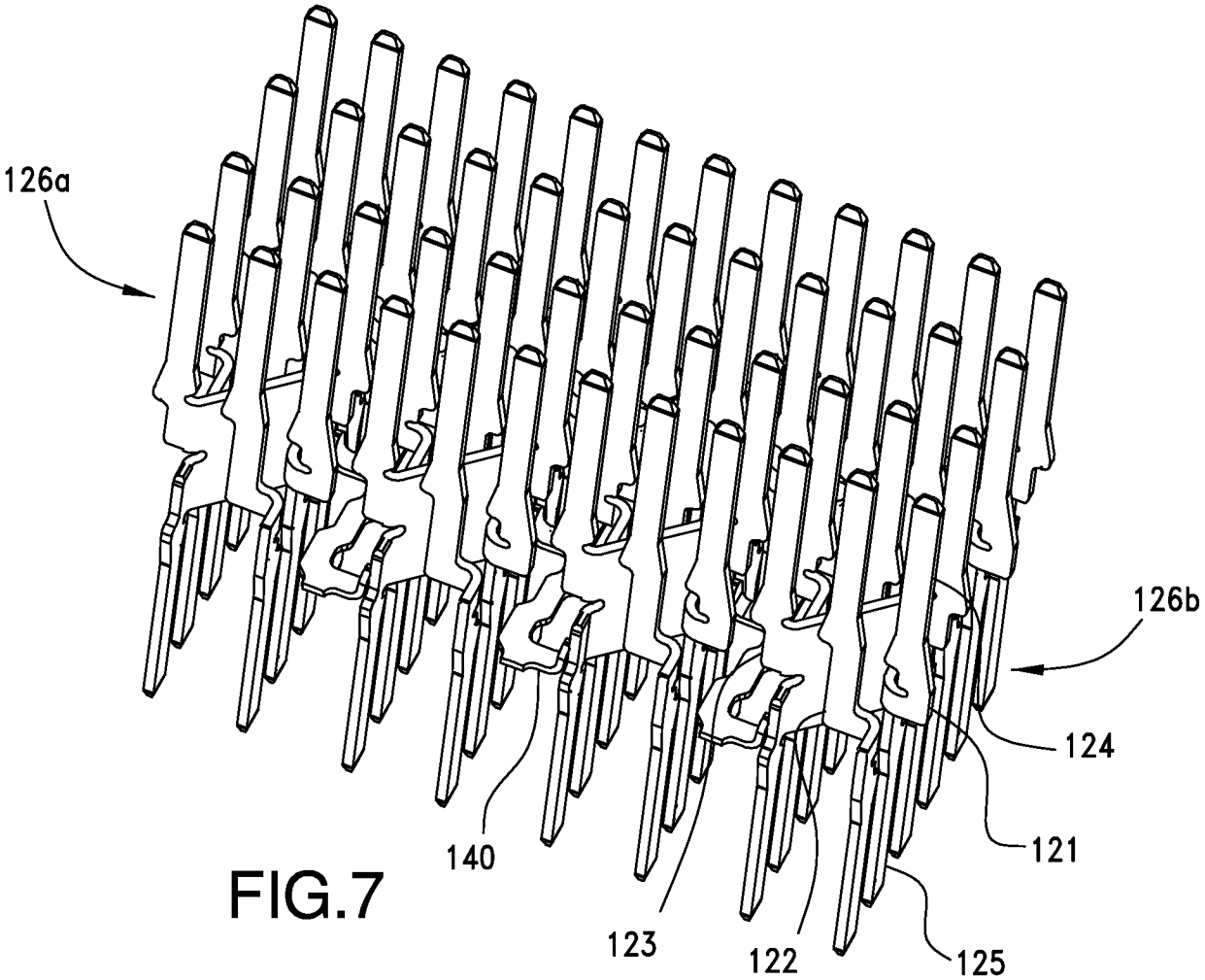
FIG. 7 illustrates a perspective view of terminals supported by the housing of the adaptor connector.
Figure 8:
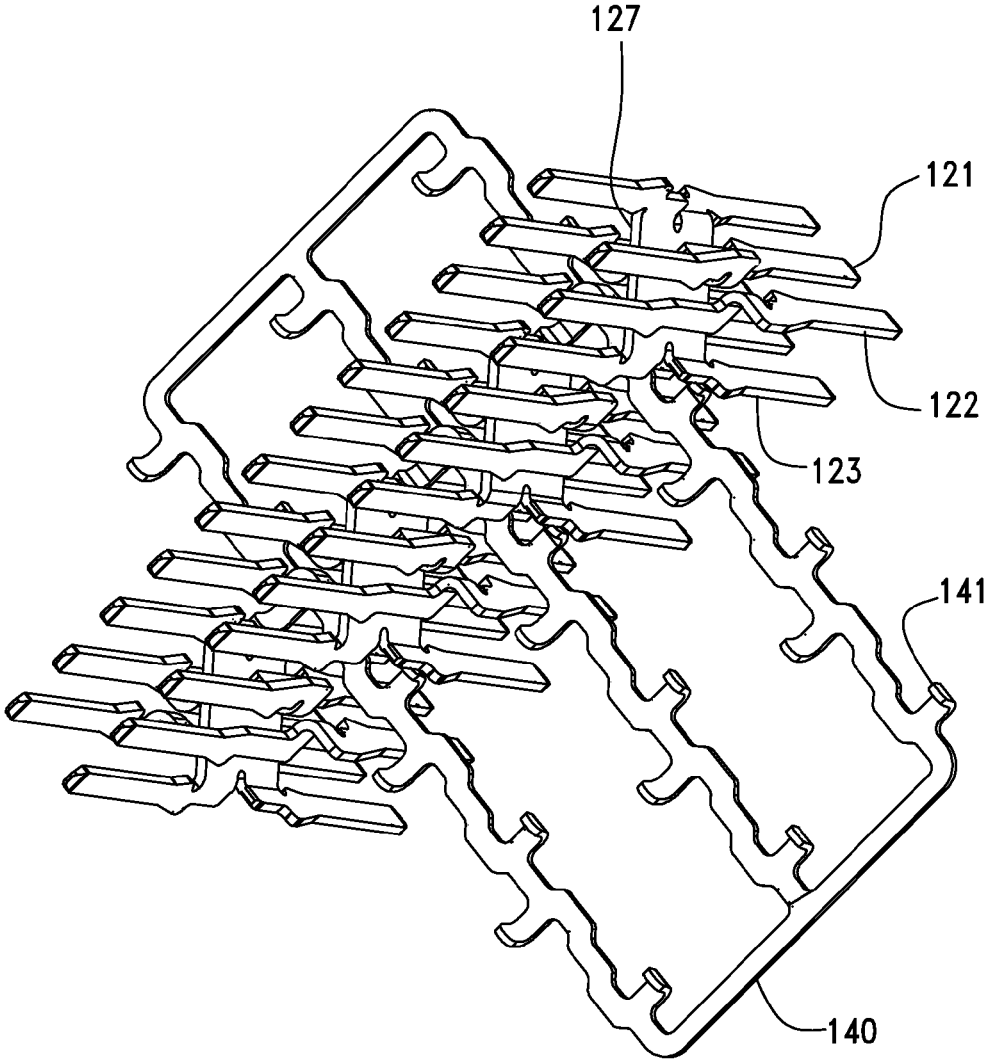
FIG. 8 illustrates a partial perspective view of the embodiment depicted in FIG. 7.

The detailed description that follows describes exemplary embodiments and is not intended to be limited to the expressly disclosed combination(s). As can be appreciated, a number of features are being disclosed. It should be noted, however, that the disclosed features do not necessarily have to be used in the depicted configurations. Therefore, unless otherwise noted, features disclosed herein may be combined together to form additional combinations that were not otherwise shown for purposes of brevity. Furthermore, certain features can be combined but also may be used separately to provide a connector system that provides the desired balance between performance and cost. Thus, the depicted features have broad application.

Looking first at FIGS. 1-4, an embodiment of connector system 5 that includes an adaptor 100 is depicted. The connector system 5 includes a first connector 20 that is coupled to a first side of the adaptor 100 and is mounted to a first board 10. The connector system 5 also includes a second connector 60 that is mounted to a second board 50 and coupled to a second side of the adaptor 100.

As depicted, the first and second connector 20, 60 are representative of orthogonal connectors commonly used in backplane architecture. In such configurations, the orthogonal connectors include a number of terminals that are inserted into vias in the boards and can be soldered into place so as to be permanently mounted on the board. It should be noted that in both cases (soldered versions and simple press-fit versions) it is generally desirable to only insert the terminal tails into the vias once as there is the possibility of some plastic deformation which could affect subsequent installations. Thus both versions are intended to be permanent but as a practical matter a press-fit version is sometimes easier to rework. Of course the orthogonal connectors could be unsoldered if the board was reworked and but usually the soldered connection is considered permanent. In contrast, the adaptor can be considered removably coupled to the first and second connector because it does not need to be soldered. It should be noted that while such a configuration is expected to be the most common system configuration, the adaptor is not limited to working with connectors so configured. Furthermore, it should be noted that the adaptor could also be configured to be mounted to a midplane (provided the midplane included the proper holes) however the concept of mounting a housing to a circuit board is relatively known to persons of skill in the art and thus will not be discussed in detail herein.

As is common, the first and second connectors 20, 60 can be configured as the second connector 60 is depicted by including a plurality of wafers 62 supported by a housing 64. The wafers 62 can be configured to support terminals and in an embodiment the terminals can provide differential coupling via an edge to edge coupling between adjacent terminals. The terminals that provide the differential coupling are referred to as signal terminals. To provide acceptable cross-talk performance in a dense terminal configuration (e.g., greater than 50 terminals per square inch), differential pairs of terminals in the same wafer are often separated by a ground terminal. As is known, the ground and signal terminals may have different body cross sections but typically will have a more uniform contact interface, and typically are arranged in a row of contacts aligned with the wafer. Thus, a wafer in the connector can provide a row of terminals that alternate between pairs of signal terminals and a ground terminal but provides a uniform contact interface.

It should be noted, that the first and second connectors 20, 60 need not be right angle connectors. In other words, the adapter would also be suitable for use with mezzanine style connectors.

FIGS. 4-10 illustrate features of an embodiment of an adaptor. As noted above, certain features illustrated could be omitted if less performance was needed or the application was more sensitive to cost than performance issues. The depicted configuration, however, is well suited to offer a adaptor that is suitable for data rates in excess of 15 Gbps and can be used in systems where the performance requirement is 20 Gbps or greater. Naturally, removing certain features (e.g., a commoning element) would provide an adaptor suitable for data rates greater than 10 Gbps but such a connector would tend to have a lower upper performance level.

As depicted, the adaptor 100 includes a first recess 101 that accepts the first connector 20 and a second recess 102 that accepts the second connector 60. Both the first and second recess 101, 102 are defined by an external wall 105 and a floor 107 with a first side 107*a* and a second side 107*b*. As depicted, the external wall 105 extends around a perimeter of the floor 107, however in alternative embodiments the external wall could include a notch or gap that would allow for improved air flow over the terminals. The advantage of having the external wall extend around the perimeter is that an enclosed socket can be provided that is substantially protected from external dust or allowing external items contact the terminals. This has been determined to be of greater interest in the event the adaptor is not positioned in an aperture of a midplane. It should be noted that any desirable perimeter shape for the external wall could be used (e.g., non-rectangular perimeter shapes) but the depicted perimeter shapes tend to be more suitable for use with the right angle connectors The floor 107 supports a terminal array 120 that includes at least a ground terminal and a pair of terminals that are configured to provide a differential signal pair. For example, the terminal array 120 can include a first terminal 121, a second terminal 122 and a third terminal 123 where the first and second terminals 121, 122 are configured to provide a differential signal pair and the terminal 123 provides a ground terminal. The first, second and third terminals 121, 122, 123 each have a first contact 124 in a first row 126*a*. As depicted, the first contacts 124 have a rectangular shape and are in a first orientation. The first and second terminals 121, 122 also have a second contact 125 in a second row 126*b* and the first row 126*a* is perpendicular to the second row 126*b*. The signal terminals 121, 122 also include a body portion 128 that couples the first and second contact 124, 125 and the body portion provides the right angle transition between the first and second contact 124, 125. The body portion can be mounted in the floor 107 and thus serves to support the first contacts 124 in the first recess 101 and to also support the second contacts 125 in the second recess 102.

Figure 9:
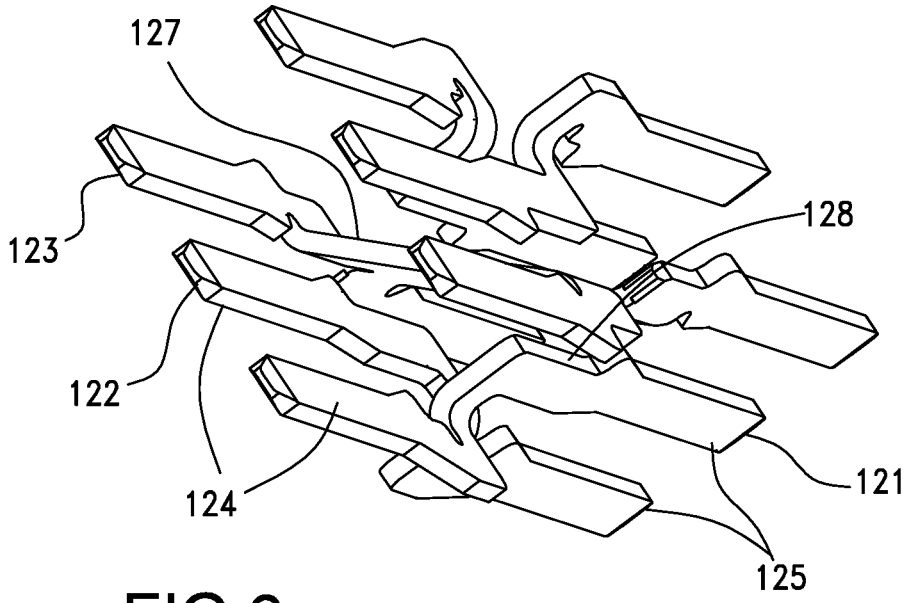
FIG. 9 illustrates a perspective view of a plurality of terminals in a configuration suitable for use in an adaptor.
Figure 10:
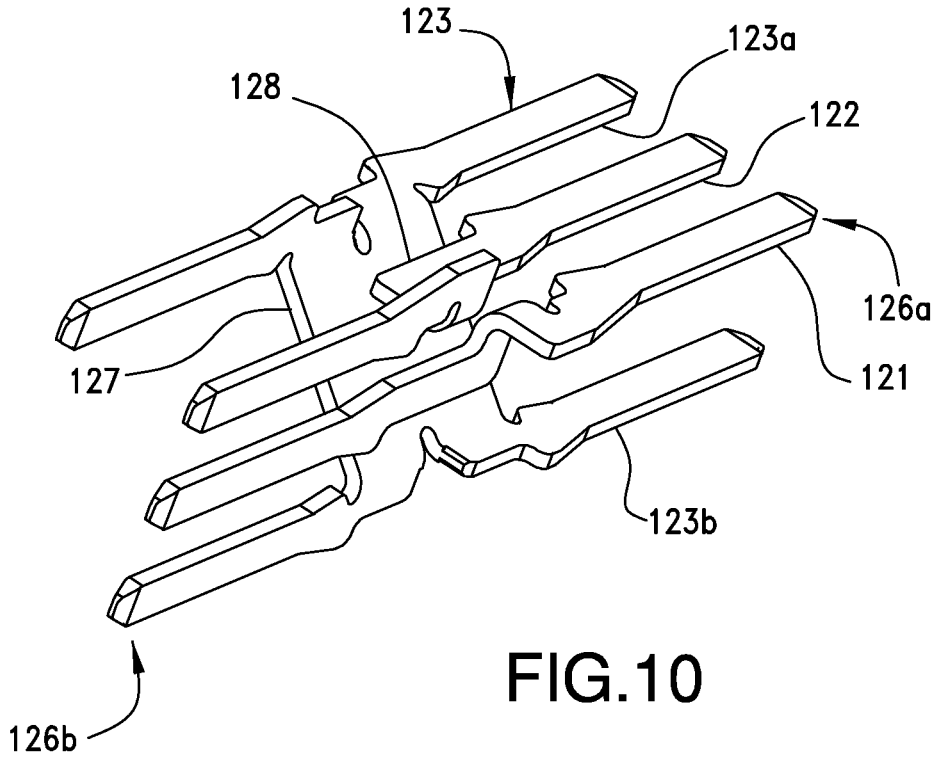
FIG. 10 illustrate a perspective partial view of a plurality of terminals depicted in FIG. 9.
Figure 11:
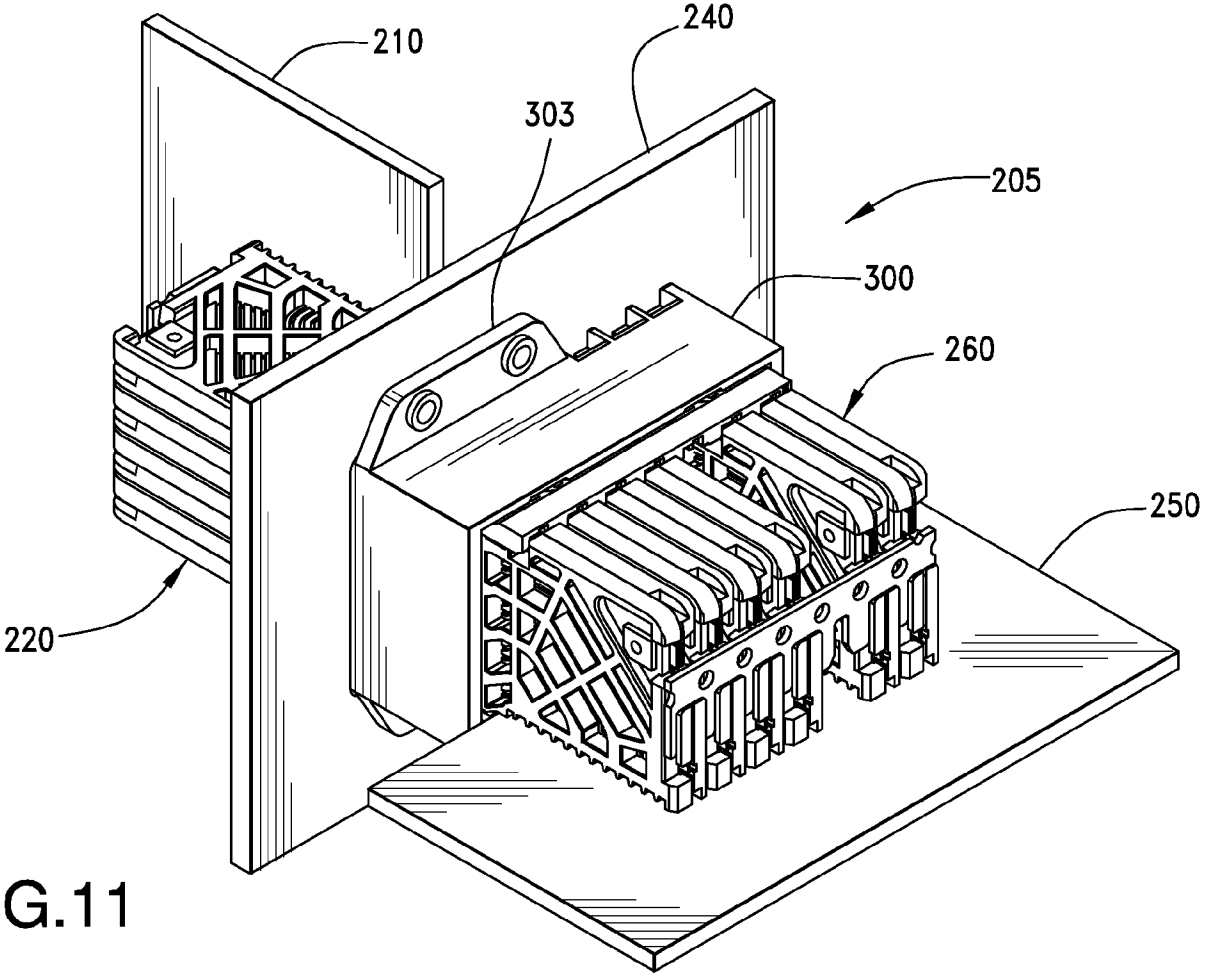
FIG. 11 illustrates a perspective view of another embodiment of a connector system with an adaptor.
Figure 12:
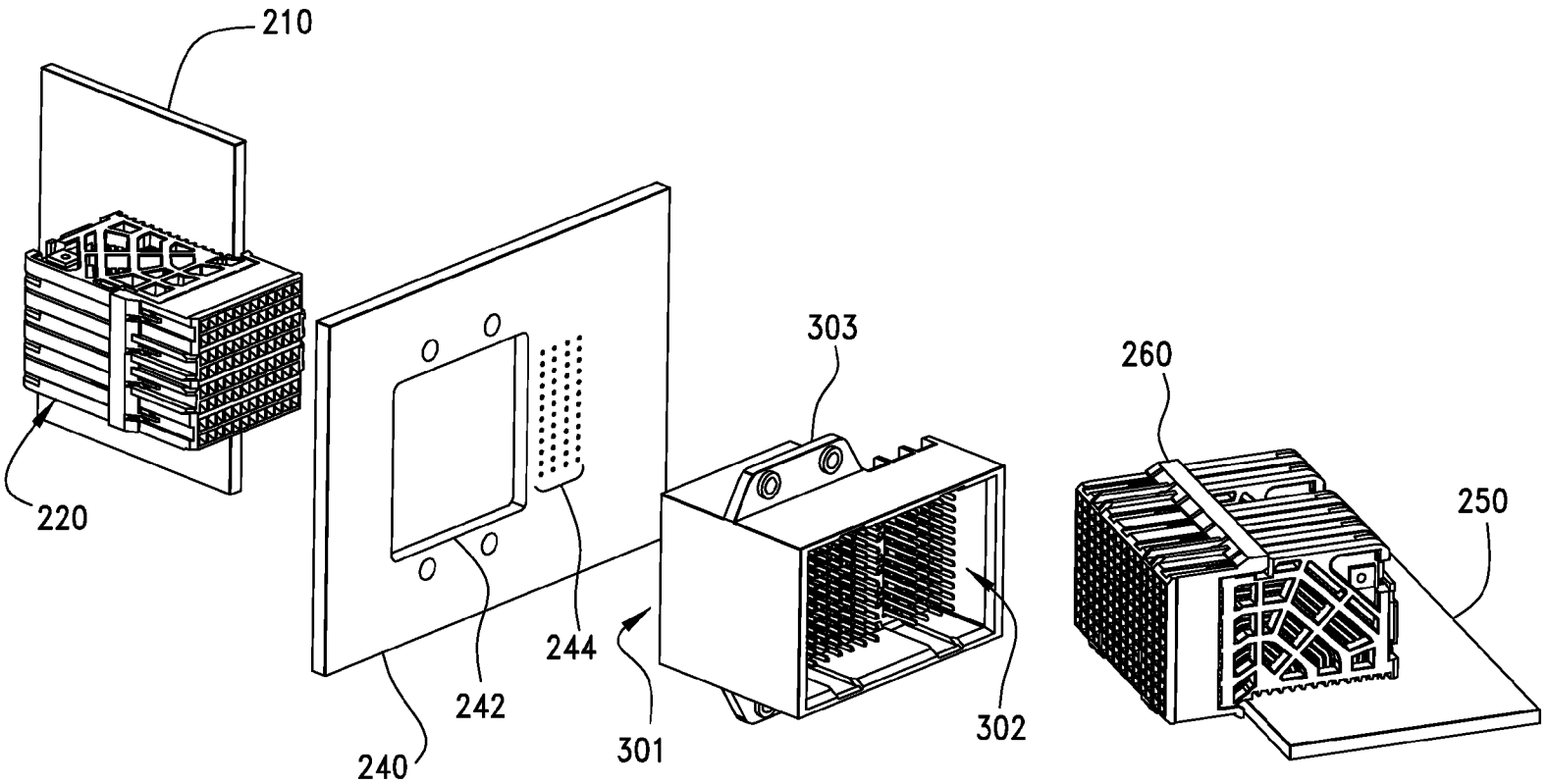
FIG. 12 illustrates a partially exploded perspective view of the embodiment depicted in FIG. 11.
Figure 13:
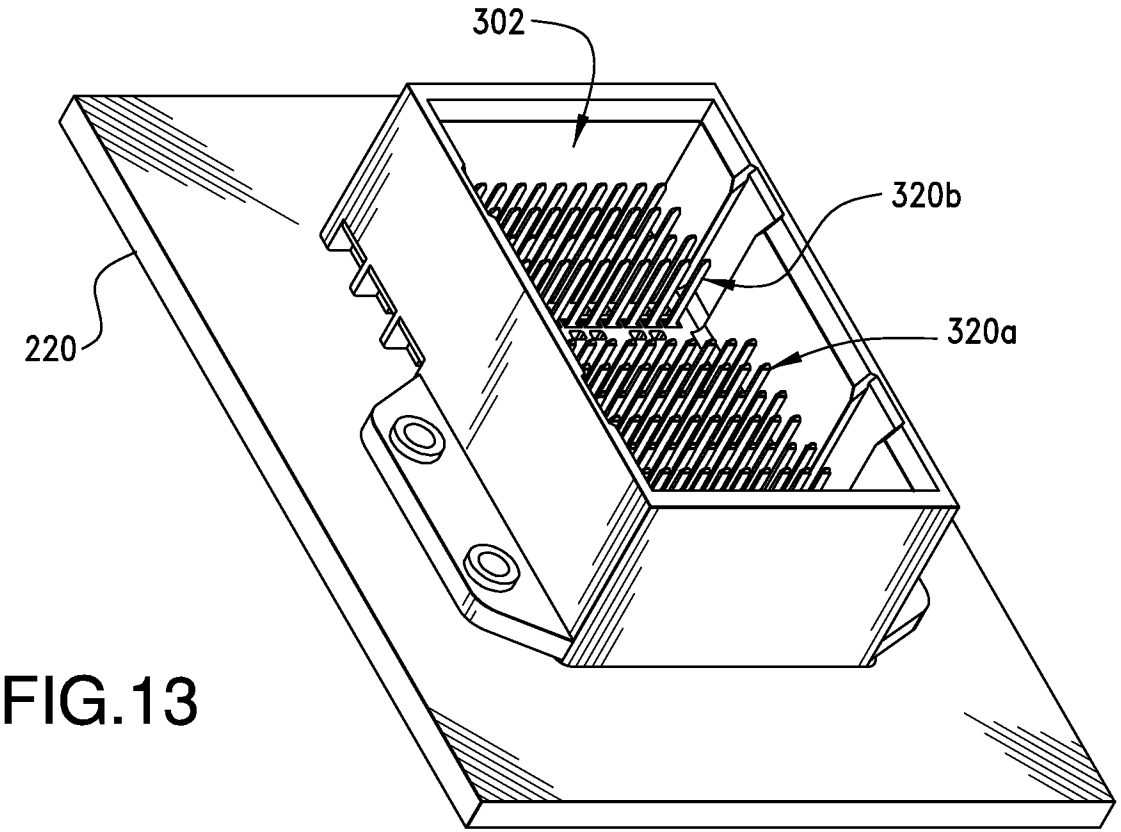
FIG. 13 illustrates a perspective view of an embodiment of an adaptor suitable for mounting to mid-plane.
Figure 14:
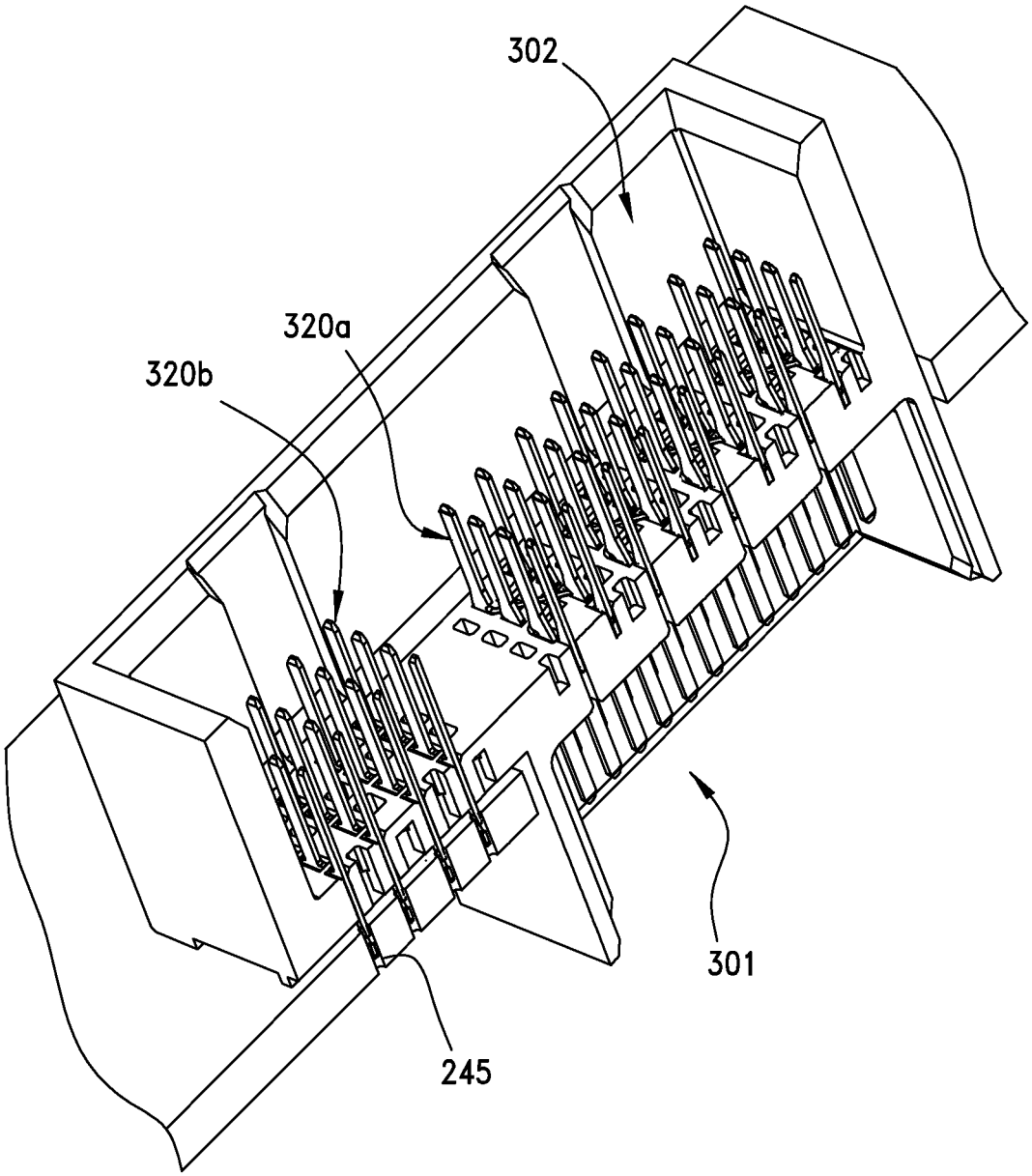
FIG. 14 illustrates a perspective view of a cross-section of the adaptor depicted in FIG. 13.
Figure 15:
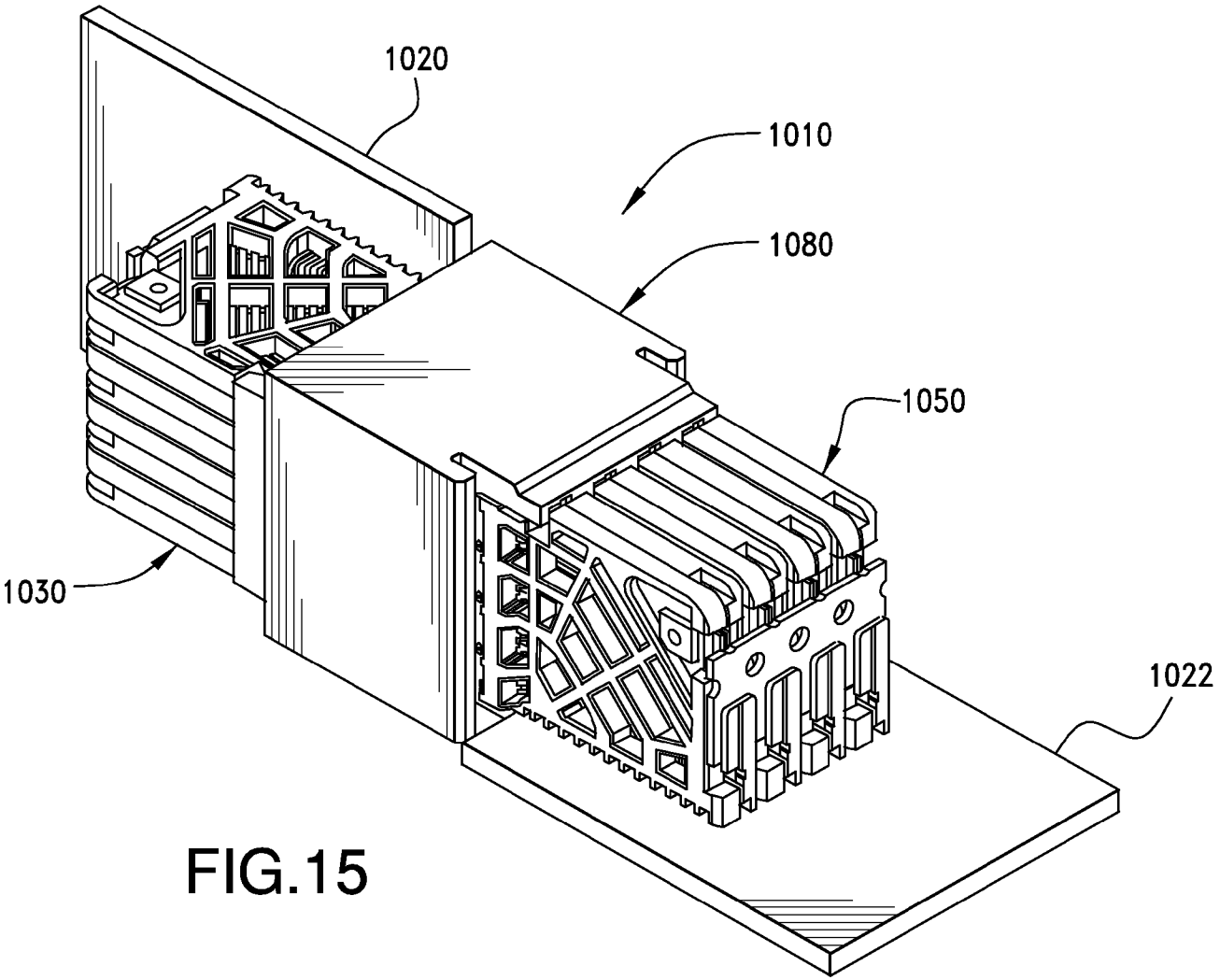
FIG. 15 illustrates a perspective view of another embodiment of a connector system.
Figure 16:
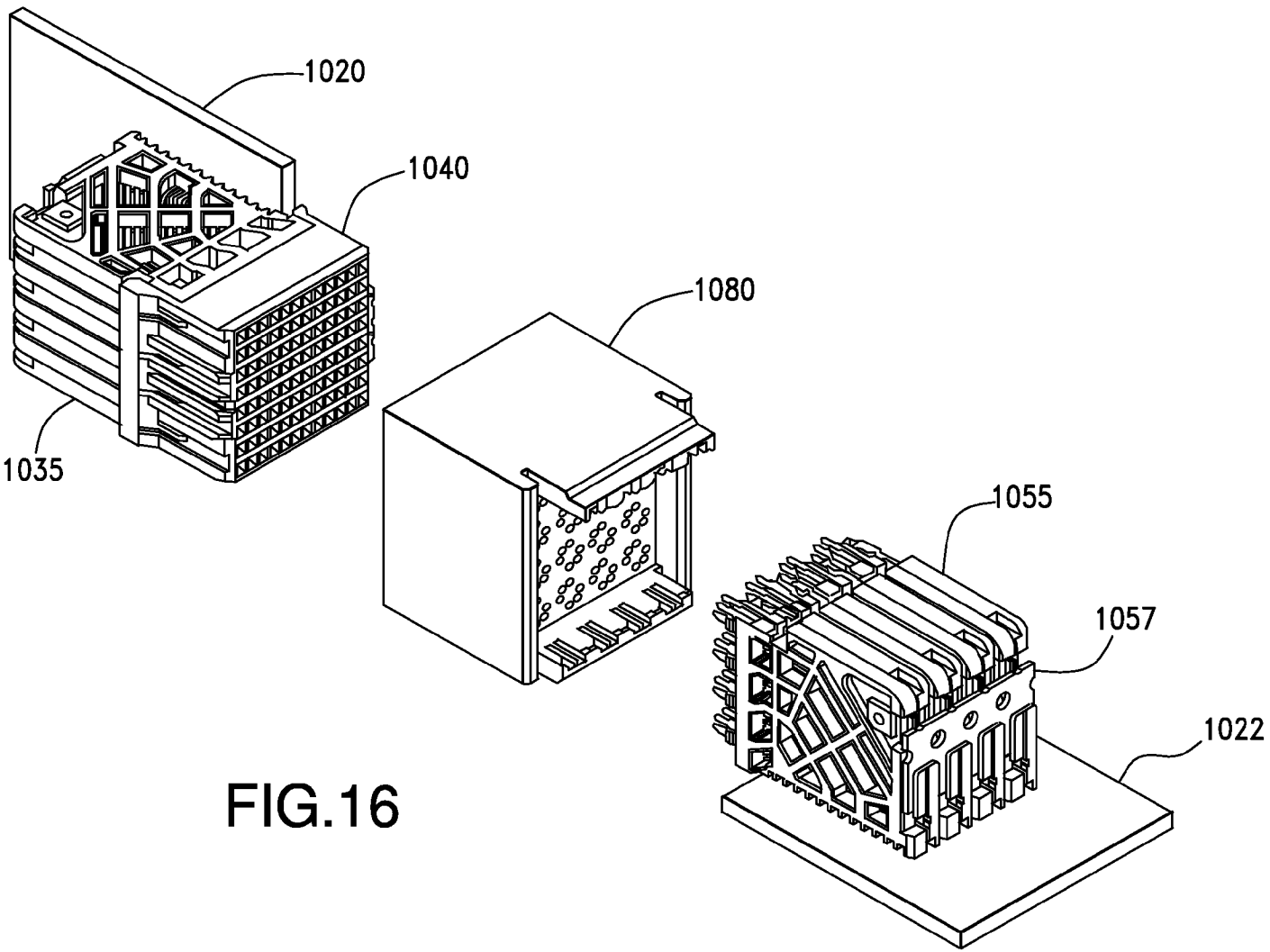
FIG. 16 illustrates a partially exploded perspective view of the embodiment depicted in FIG. 15.
Figure 17:
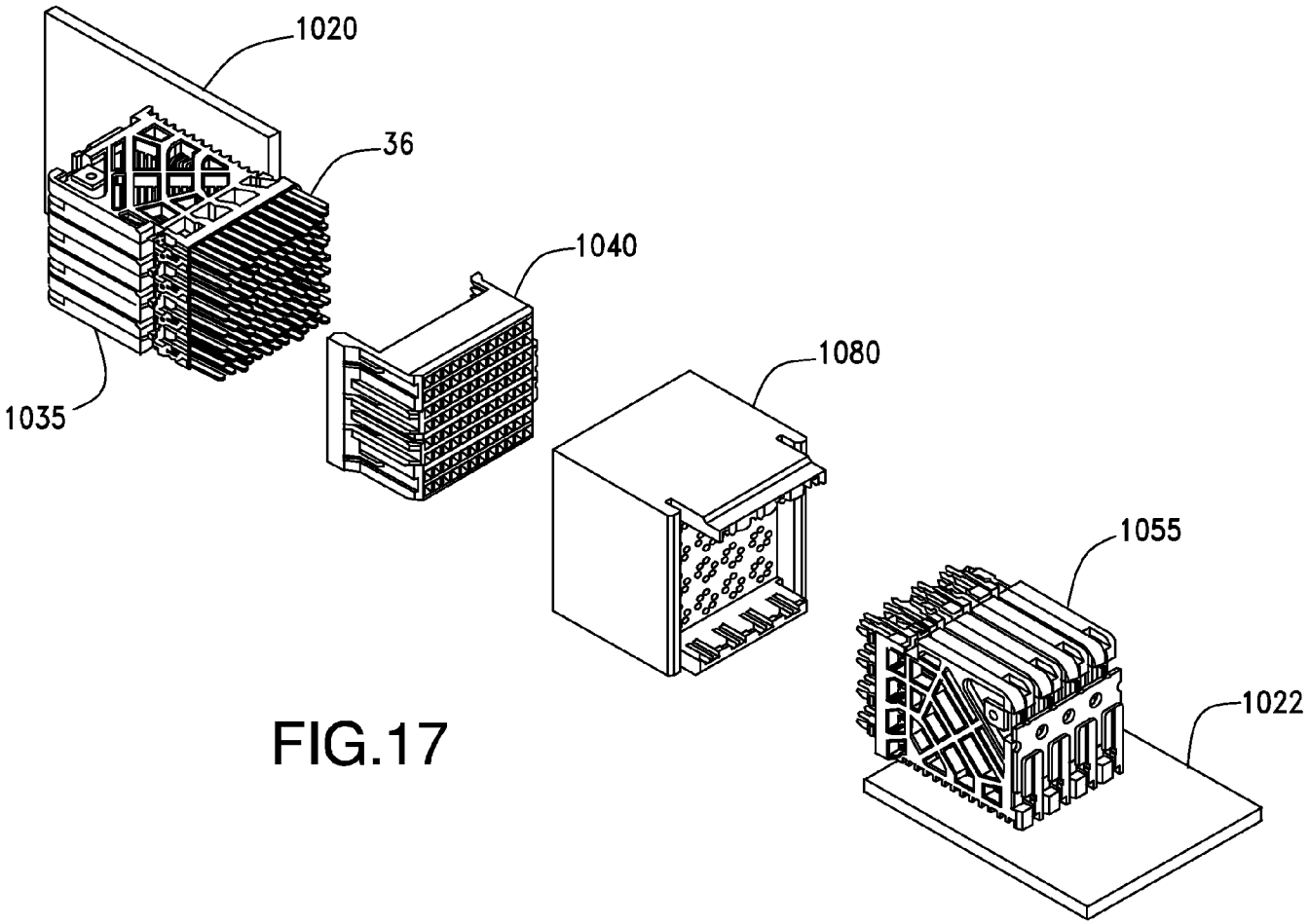
FIG. 17 illustrates another partially exploded perspective view of the embodiment depicted in FIG. 15.
Figure 17A:
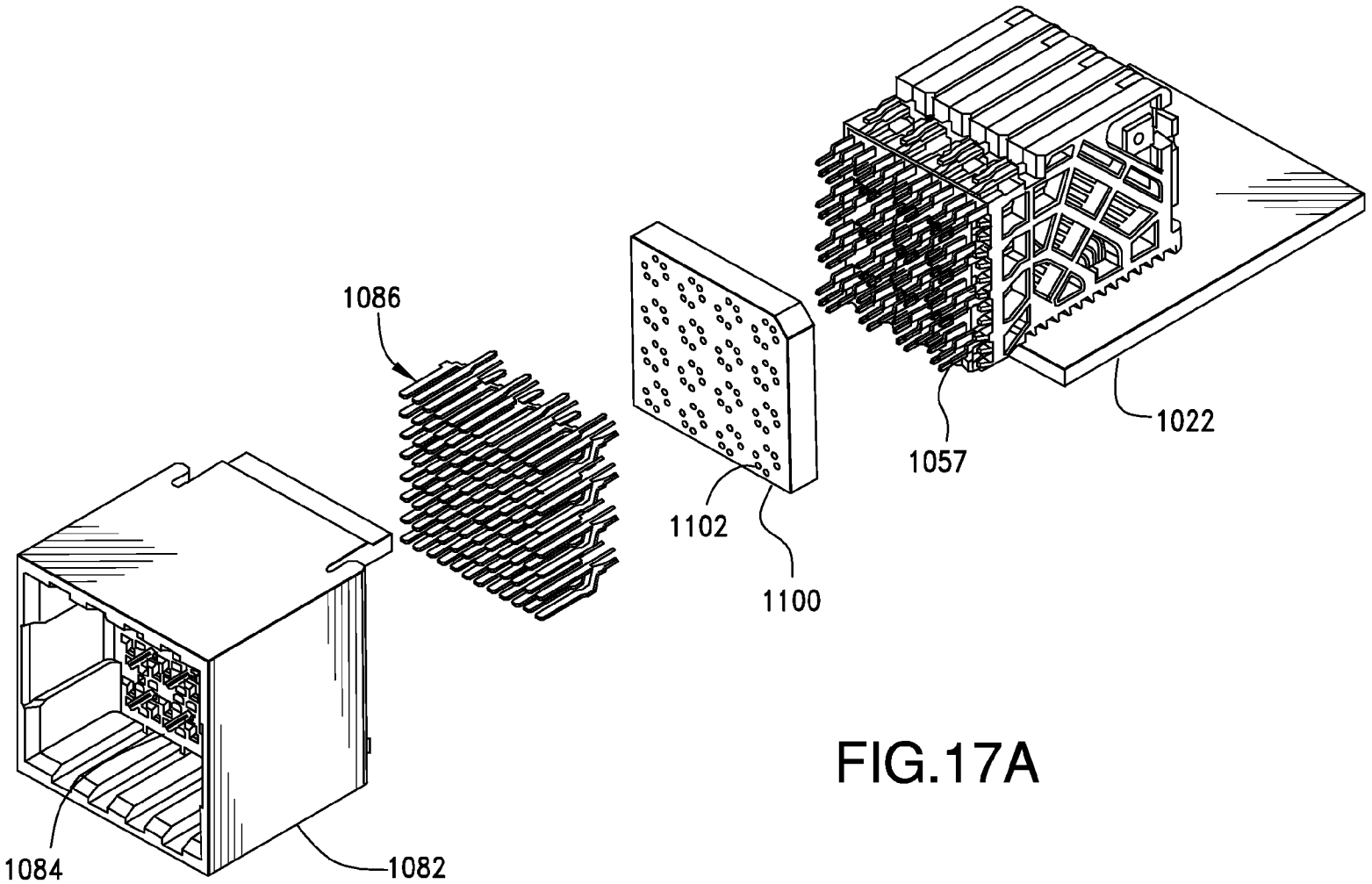
FIG. 17A illustrates a simplified partially exploded perspective view of the embodiment depicted in FIG. 15.
Figure 18:
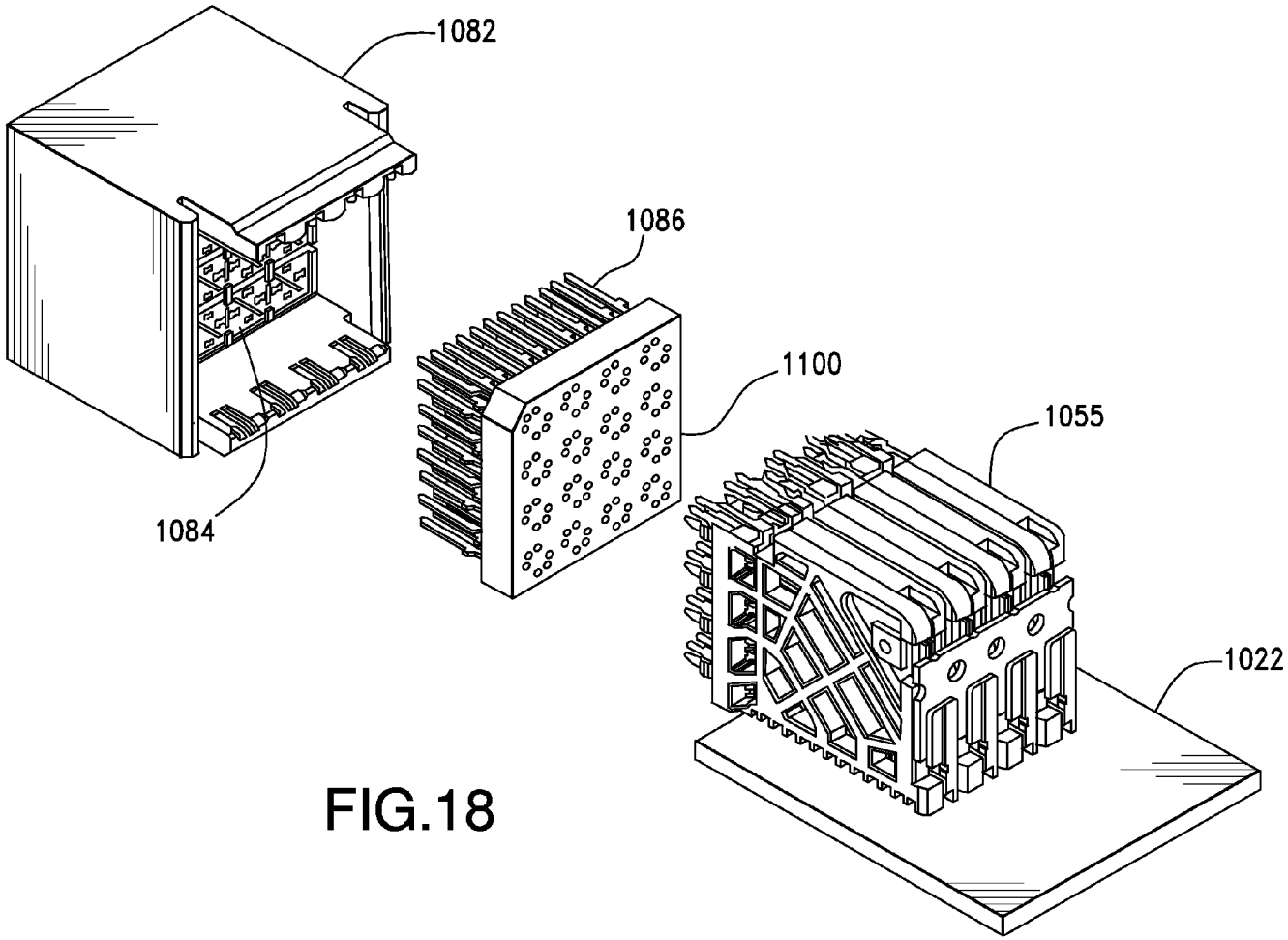
FIG. 18 illustrates another partially exploded perspective view of the embodiment depicted FIG. 17A.
Figure 19:
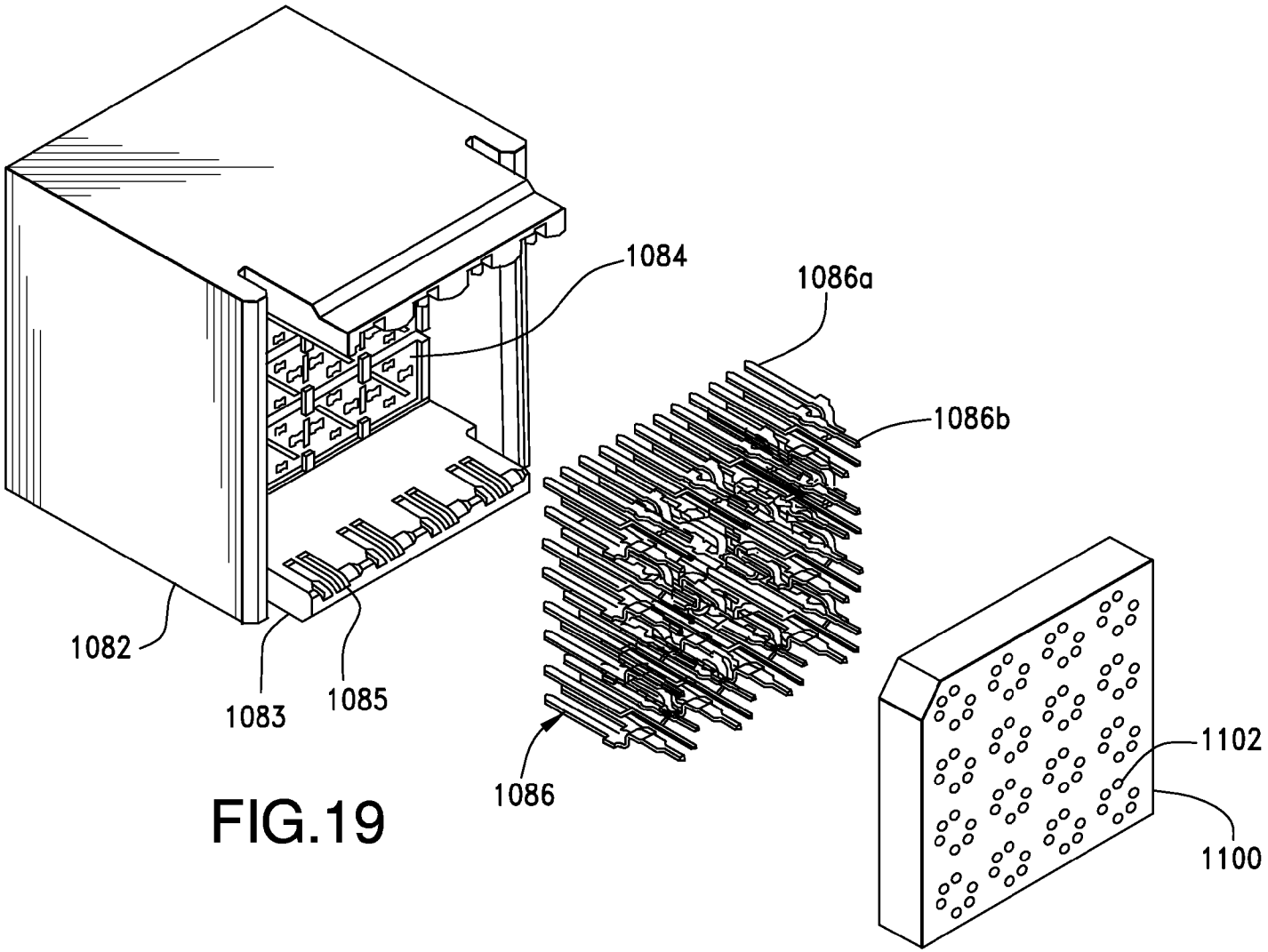
FIG. 19 illustrates a simplified partially exploded perspective view of the embodiment depicted in FIG. 17A.
Figure 20:
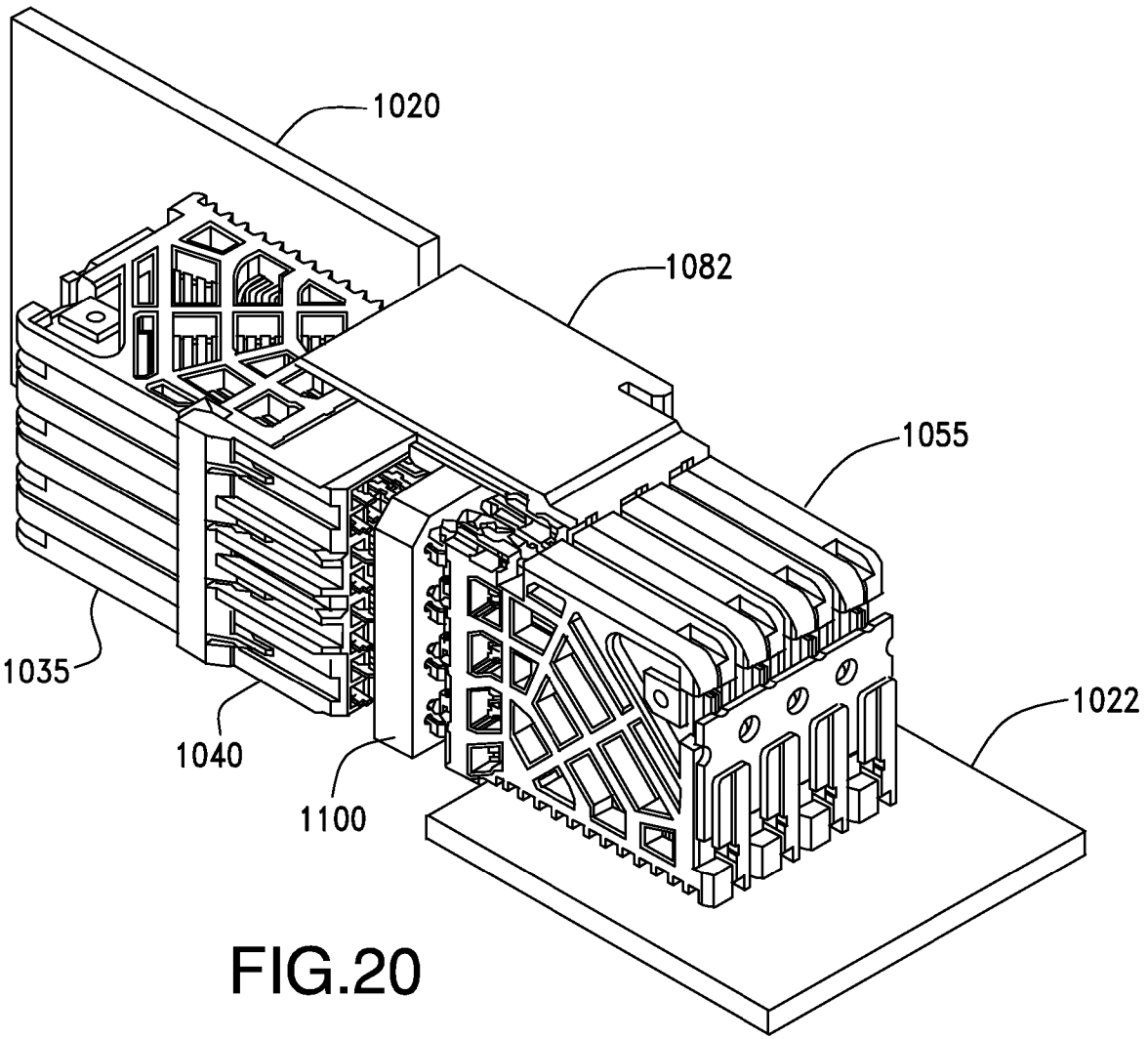
FIG. 20 illustrates a perspective cross-sectional view of the assembly picked in FIG. 15.
Figure 20A:
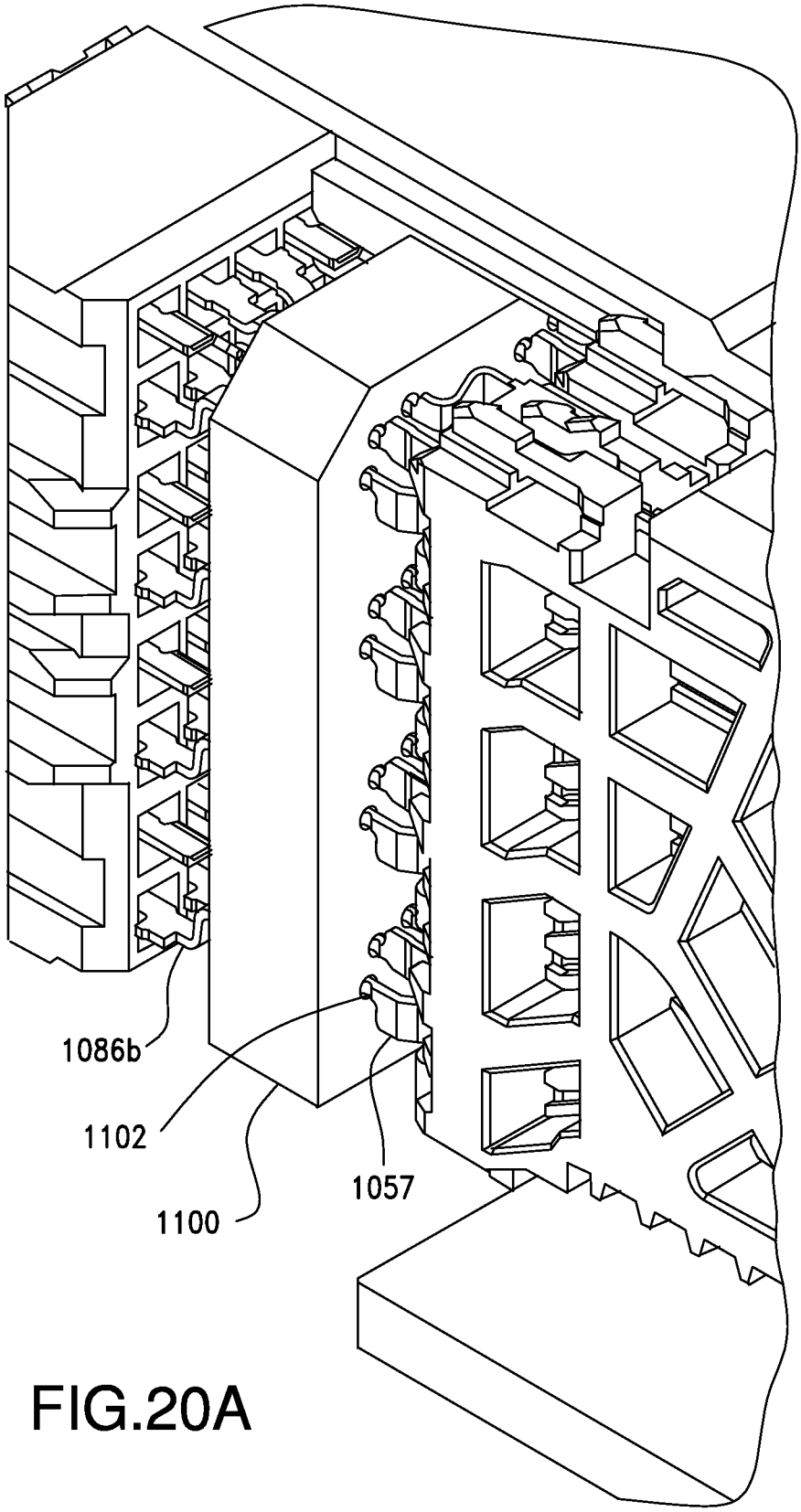
FIG. 20A illustrates an enlarged view of the embodiment depicted in FIG. 20.

As depicted, the third terminal 123 is a ground terminal with a first leg 123*a* coupled to a second leg 123*b* by a body 127. As depicted, the first and second leg 123*a*, 123*b* and the body 127 form an "H" shaped terminal. While not required, FIG. 9 illustrates that this construction helps the body 127 provide isolation between a first differential pair of signal terminals and a second differential signal pair. Such isolation has been determined to be particularly advantageous in a dense, high speed connector such as is depicted (for example, where the in-row pitch is not more than 1.5 mm and the pitch between rows is not more than 2.5 mm).

While it is advantageous to electrically isolate one pair of differential signal pair of terminals from another pair of differential signal pair of terminals, it is generally undesirable to isolate one ground terminal from another. For one thing, if the ground terminals are isolated, the unintended modes present in the connector place energy on the ground terminal and this energy will tend to create voltage differences between the ground terminal and some reference ground, thus potentially creating an energy reflection as the ground terminal encounters impendence discontinuities (such as when the ground terminals couple to other terminals). Therefore, it is has been determined that it can be advantageous to common ground terminals. Such commoning is relatively straightforward in a connector configured for singled-end signaling but becomes more challenging in a connector configured for differential signaling. As depicted, however, the commoning of grounds terminals can be partially accomplished by using the first and second leg 123*a*, 123*b* joined by the body 127. To provide further commoning and thus further lower any potential difference between one ground and a reference ground, a commoning bar 140 with fingers 141 that couple to one of the legs of the ground terminal can extend between rows and in an embodiment may be positioned between every other row while having fingers 141 that extend in opposing directions. It should be noted that the bar 140, while in certain embodiments can be formed from a unitary metal material, can also be formed in multiple pieces and can be made formed from other conductive materials, such as plated plastics, conductive plastics, energy dampening conductive materials and the like.

FIGS. 11-14 illustrate another embodiment of a connector system 205 that includes a connector 300 that couples a first connector 220 mounted on a first board 210 to a second connector 260 mounted on a second board 250. As can be appreciated, the connector 300 is also mounted on a midplane 240 and includes a flange 303 that can be fastened to the midplane 240. In this regard, it should be noted that the connector 100 could also include an optional flange substantially similar to the flange 303 so as to allow the connector 100 to be coupled to a midplane while omitting terminals that could mount to vias. Naturally, as the midplane would act to help secure the connector 100, the inclusion of such a flange to secure a connector to a board is not required. If a flange is included on one side or more sides of the connector 100 so as to allow the connector to be mounted to the midplane, a guiding post could also be provided on one of the flanges so as to help ensure alignment between the midplane and the connector 100 when the connector 100 was mounted to the midplane.

As can be appreciated, while the construction of the connector 300 is similar to the construction of connector 100, a first recess 301 is smaller than a second recess 302. The second recess 302 includes a first terminal array 320*a* and a second terminal array 320*b*, however the second terminal array 320*b* does not extend into the first recess but instead terminates into a via array 244 that includes plated vias 245 that receive tails from the terminals in the second terminal array 320*b*. The plated vias 245 can then be coupled to ground planes and signal traces in a conventional manner. Thus, as can be appreciated, the connector 300 enables coupling between two right angle connectors that are rotated 90 degrees with respect to each other while also allowing for mid-plane engagement. Thus, a system that includes one or both of the connectors 100, 300 can offer significant architectural flexibility while enabling high data rates.

It should be further noted that in certain embodiments of the connector 100, a first recess 101' and a second recess 102' might be configured to accept connectors with different wafer configurations. For example, the first recess 101' could be configured to mate with a 3 wafer connector where each of the 3 wafers included 8 differential pairs (e.g., a 3×8 connector). The second recess 102' could be configured to mate to a 4 wafer connector where each of the 4 wafers included 6 differential pairs (e.g., a 4×6 connector). Other possible variations include a 4×10 connector being converted to a 5×8 connector or a 6×10 connector being converted to a 5×12 connector. Thus, the connector on one side could be provided as a low profile connector while the other side could be more square-like. As can be appreciated, the ability to modify the shape of the array between two sides offers significant benefits with regarding to architectural flexibility while maintaining the number of differential pairs.

FIGS. 15-26 illustrate an embodiment of an orthogonal connector system 1010 that allows for a connection between a first board 1120 and a second board 1122 without a midplane. A first connector assembly 1030 is mounted on the first board 1120 and is coupled to a second connector assembly 1050 which is mounted on the second board 1122 and these two assemblies are configured to releasably mate together. The first connector assembly includes a conventional wafer 1035 based construction that is supported by a daughter-card housing 1040. The terminals 1036, which are supported by the wafers 1035, each include a tail portion, a contact portion and a body portion extending therebetween and provide an array of contact portions positioned in the daughter-card housing 1040.

Figure 29A:
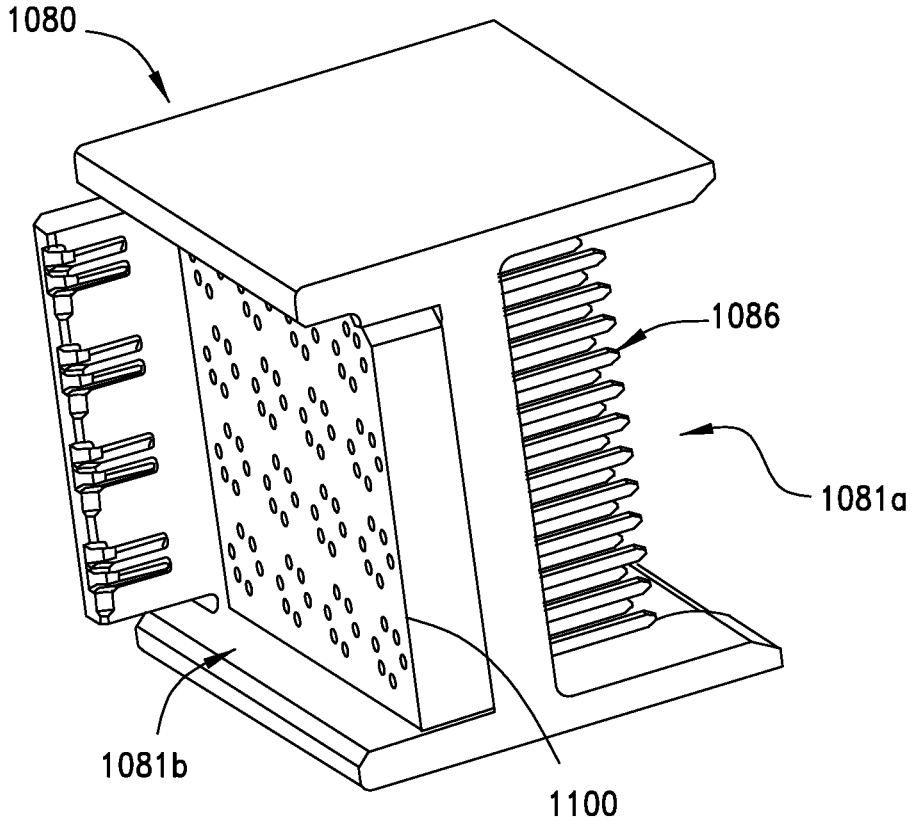
FIG. 29A illustrates a cross-sectional simplified perspective view of an embodiment of a header housing.
Figure 29B:
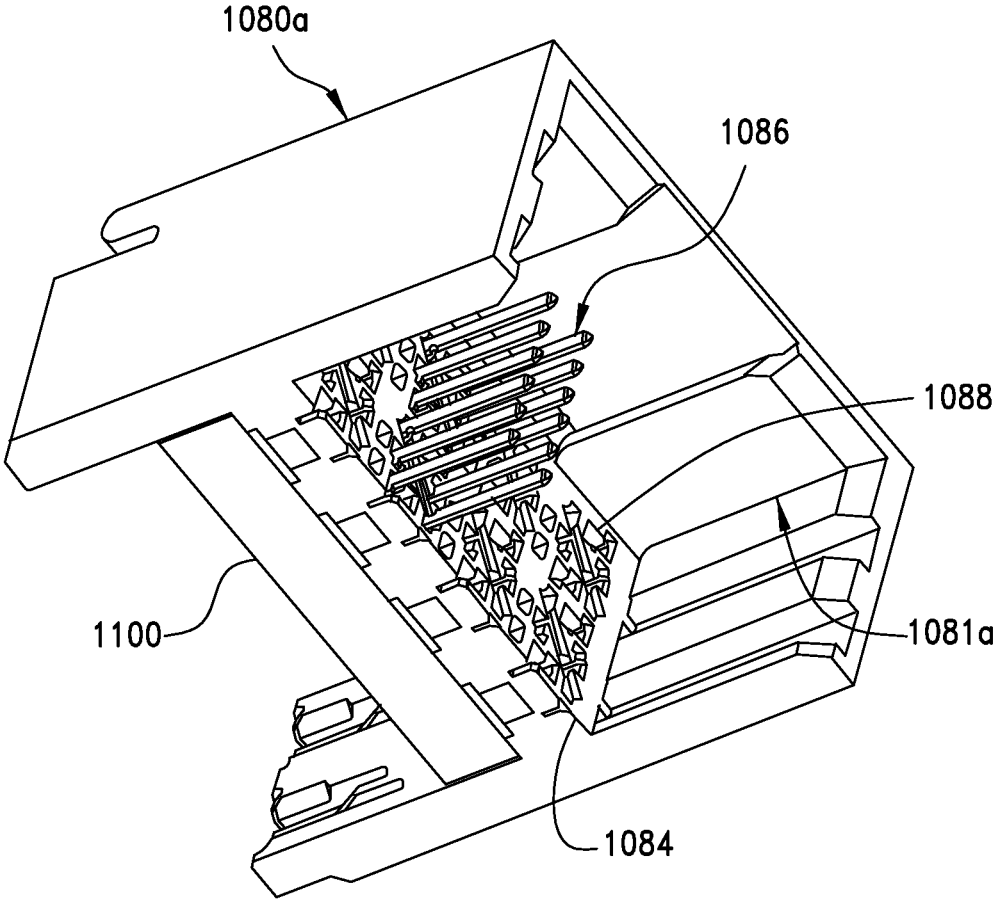
FIG. 29B illustrates another cross-sectional simplified perspective view of the header housing depicted in FIG. 29A.
Figure 29C:
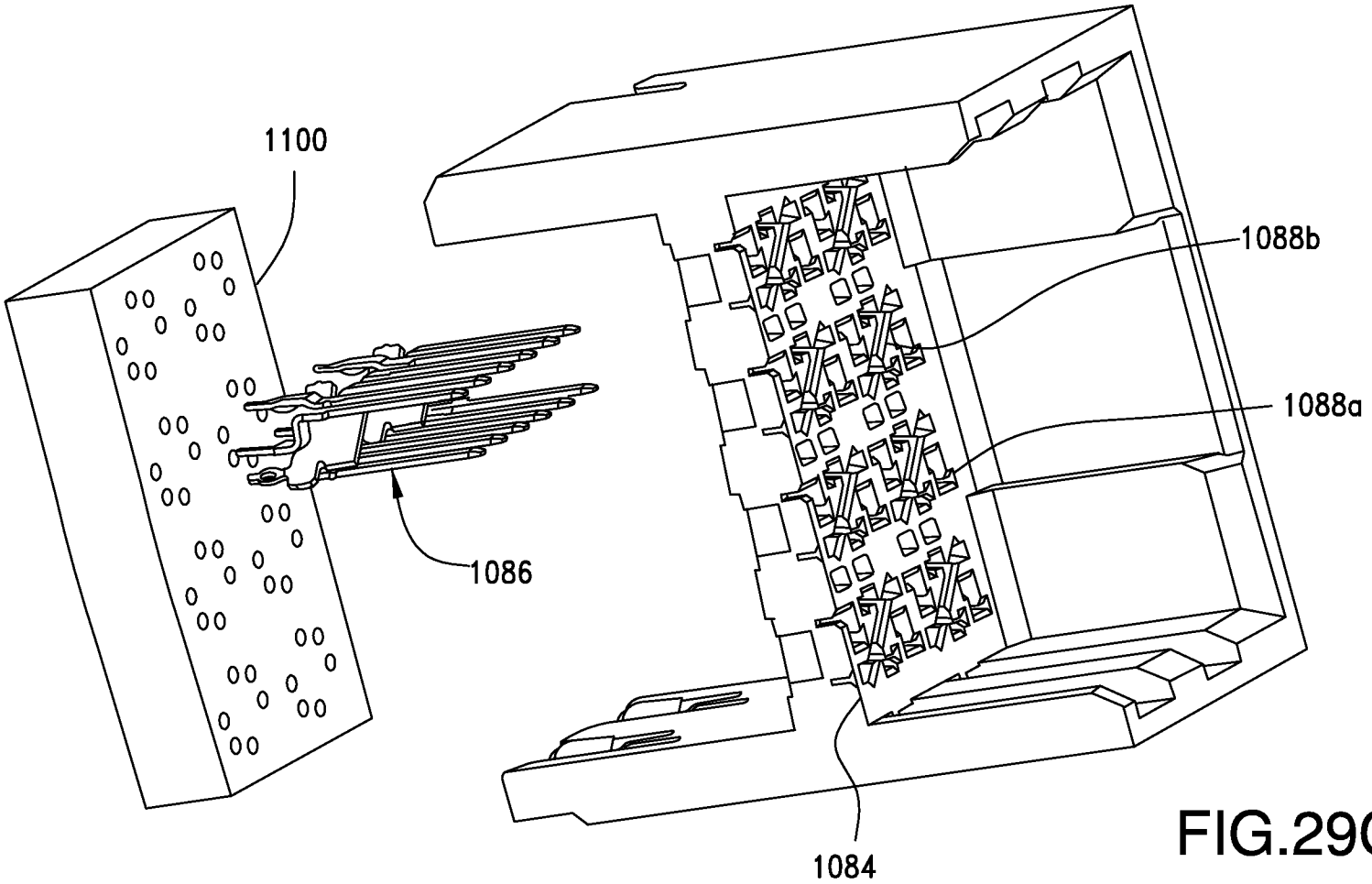
FIG. 29C illustrates an exploded perspective view of the embodiment depicted in FIG. 29B.

To allow the two connector assemblies 1030, 1050 to releasably mate, the second connector assembly includes a header housing 1080 that has contacts 1086 extending from wall 1084 in a first recess 1081*a* (FIG. 29*a*). When the daughter-card housing is inserted into the first recess 1081*a*, the terminals 1036 engage the contacts 1086. Wafers 1055 are positioned in a second recess 1081*b* and support terminals 1057 and the terminals 1057 (which include a first tail portion 1064, a second tail portion 1065 and a body portion 1066 extending therebetween) are mounted to coupler 1100, which may be a conventional circuit board sized to fit in the header housing 1080. As depicted, the coupler 1100 includes a plurality of plated thru-holes 1102 so that a contact 1086 can be electrically coupled to a terminal 1057 via the plated thru-hole 1102. It should be noted, however, the coupler 1100 could also have pads for a SMT based connection to the terminals 1057. The coupling of a terminal to a SMT pad is known in the art and is common in computer socket field and thus the technology related to such connections need not be discussed further herein. The advantage of the use of thru-holes and corresponding terminals is that thru-hole terminals can be more readily configured to provide a high degree of resistance to stresses and therefore tend to be more robust in the face of stresses caused by vibration and sudden impacts.

To help support the wafers in the corresponding recesses 1081*a*, 1081*b*, an alignment feature 85 (which may be a groove or projection) can be provided in a side 1083 of the recesses and the alignment feature 85 engages a corresponding projection or groove in the wafer.

It should be noted that while a FIG. 29A depicts a first recess 1081*a* in the header housing 1080, in an alternative embodiment, the header housing 1080 could be configured to provide a projection and the mating connector would have a recess that would mounted over the projection. In other words, the mechanical interface of the daughter-card housing 1040 and header housing 1080 could be reversed. Thus, unless otherwise noted, this feature is not intended to be limiting.

Thus, the first connector assembly 1030 can be fixed to the first board 1120 and the second connector assembly 1050 can be fixed to the second board 1122 while the two connector assemblies 1030, 1050 can be mated by inserting the daughter-card housing 1040 into the header housing 1080. As header housing is fixed to the wafers 1055, which are in turn fixed to the second board 1122, the depicted system allows a connection that previously could only be accomplished via a midplane architecture that required the use of two releasably mateable connections and a minimum of three separate solder operations. In contrast to prior designs, however, the depicted configuration allows for the use of a single releaseably mateable connection and two solder operations (assuming that each board is considered a separate solder operation).

As can be appreciated, the terminals 1036 are rotated 90 degrees from the terminals 1057 about the common plane formed by coupler 1100. As has long been appreciated, when two sets of terminals that are orientated 90 degrees apart are joined via a common plane, the connection through the common plane needs to handle the transition. For systems where the terminals on both sides are in a particular pattern (such as in a row that has a conventional repeating ground, signal, signal pattern), this most readily can be accomplished by having terminals on both sides rotate 45 degrees at the point where they couple to the coupler 1100. Of course, other angles, such as 40/50 or 30/60 would also work. In addition, the plated thru-hole could internally handle the 90 degree angle change (although this would tend to slightly increase the distance the plated thru-hole would travel).

Figure 21A:
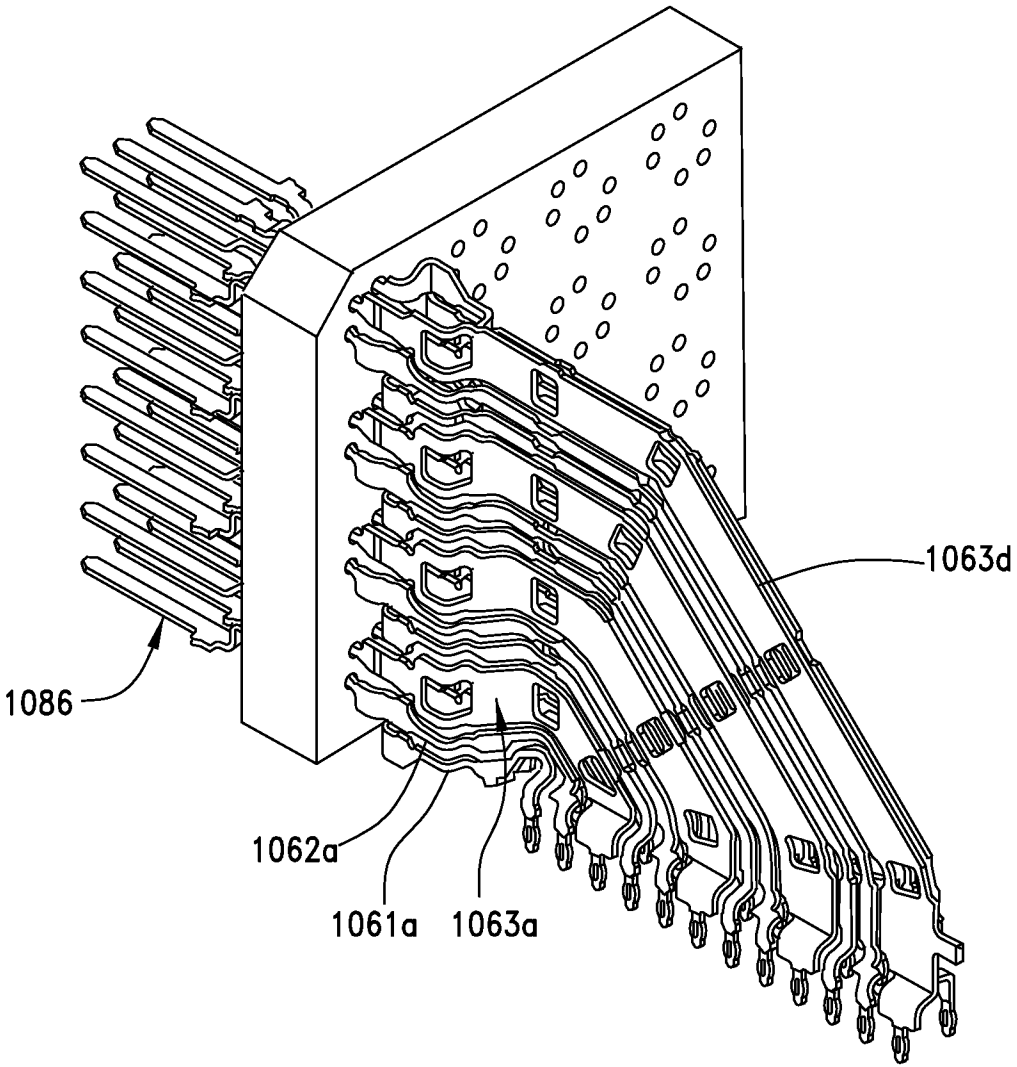
FIG. 21A illustrates a partial perspective view of the embodiment depicted in FIG. 15.
Figure 21B:
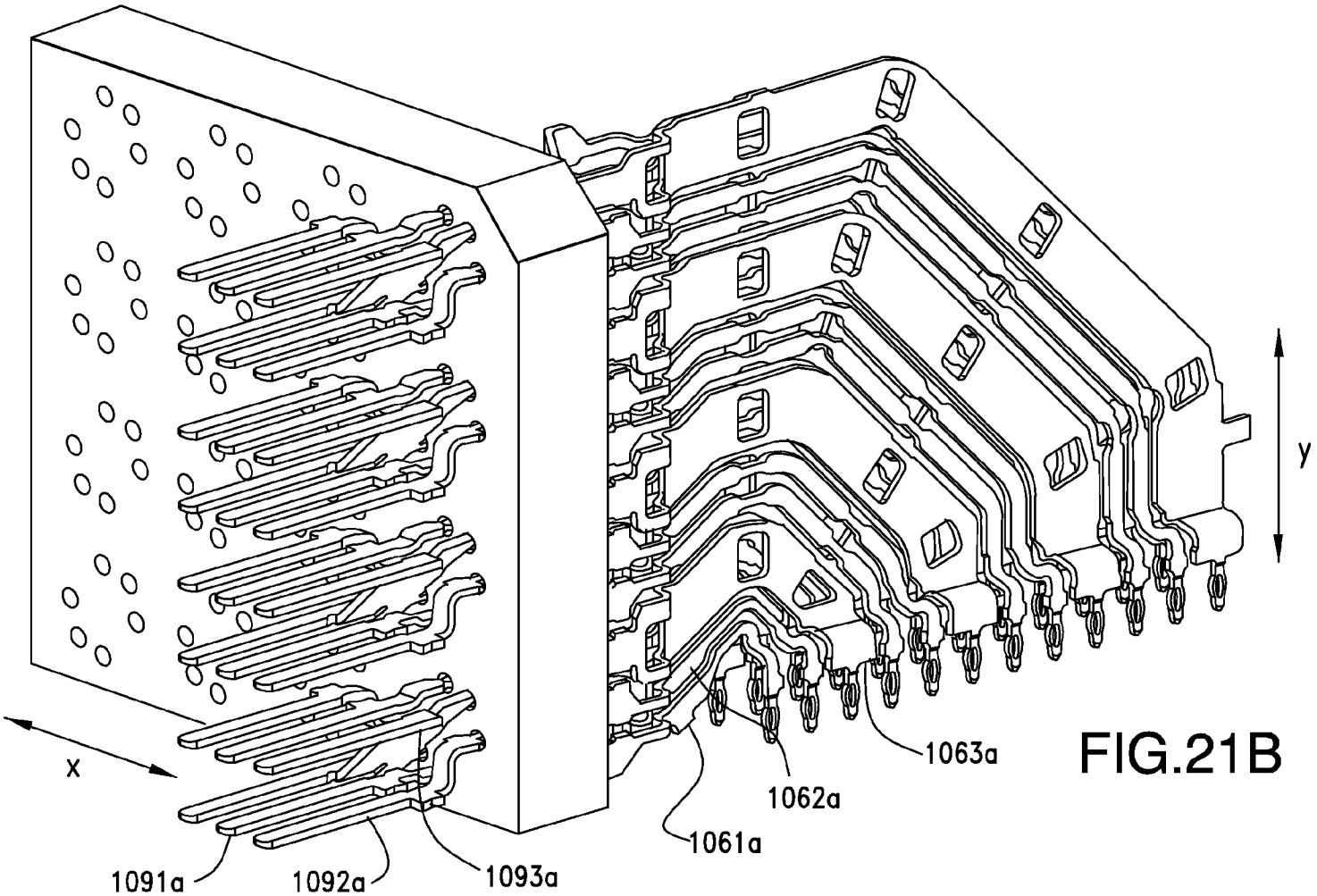
FIG. 21B illustrates another perspective view of the embodiment depicted in FIG. 21A.
Figure 22:
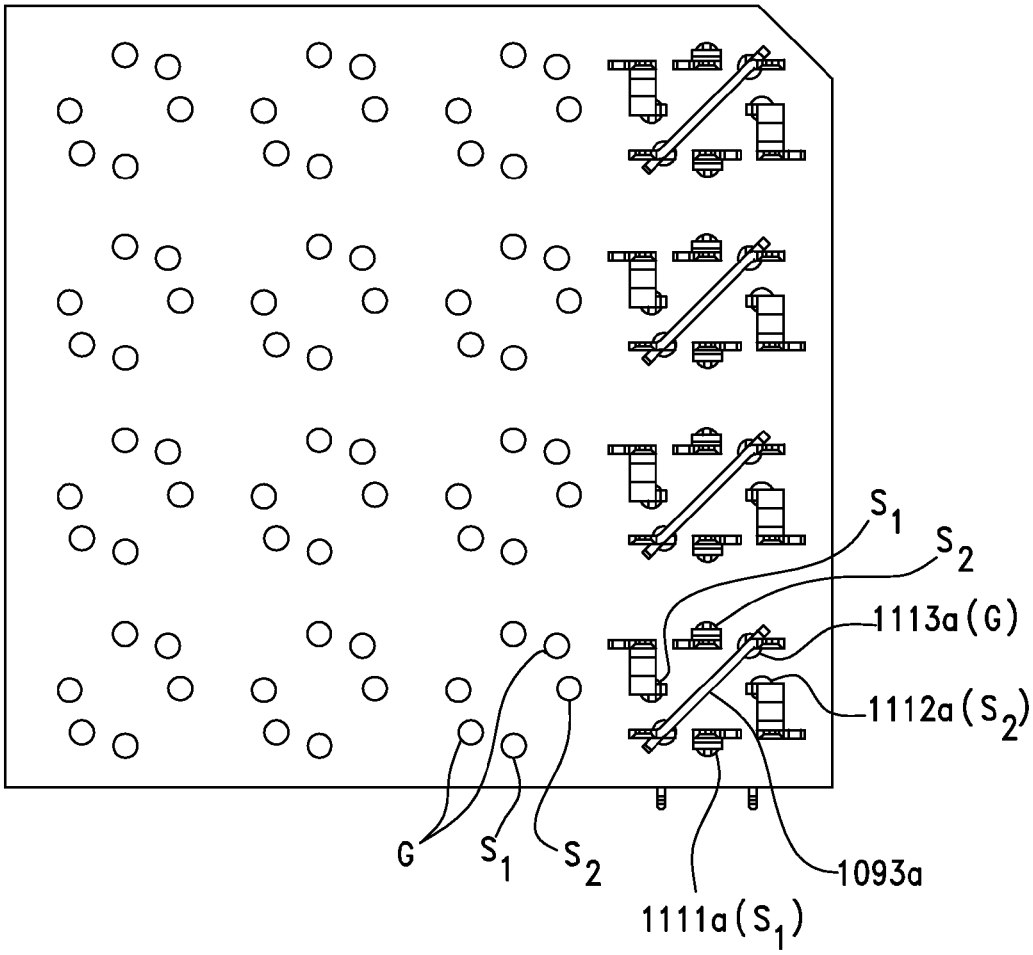
FIG. 22 illustrates an elevated side view of the embodiment elected in FIG. 21*a*.
Figure 23:
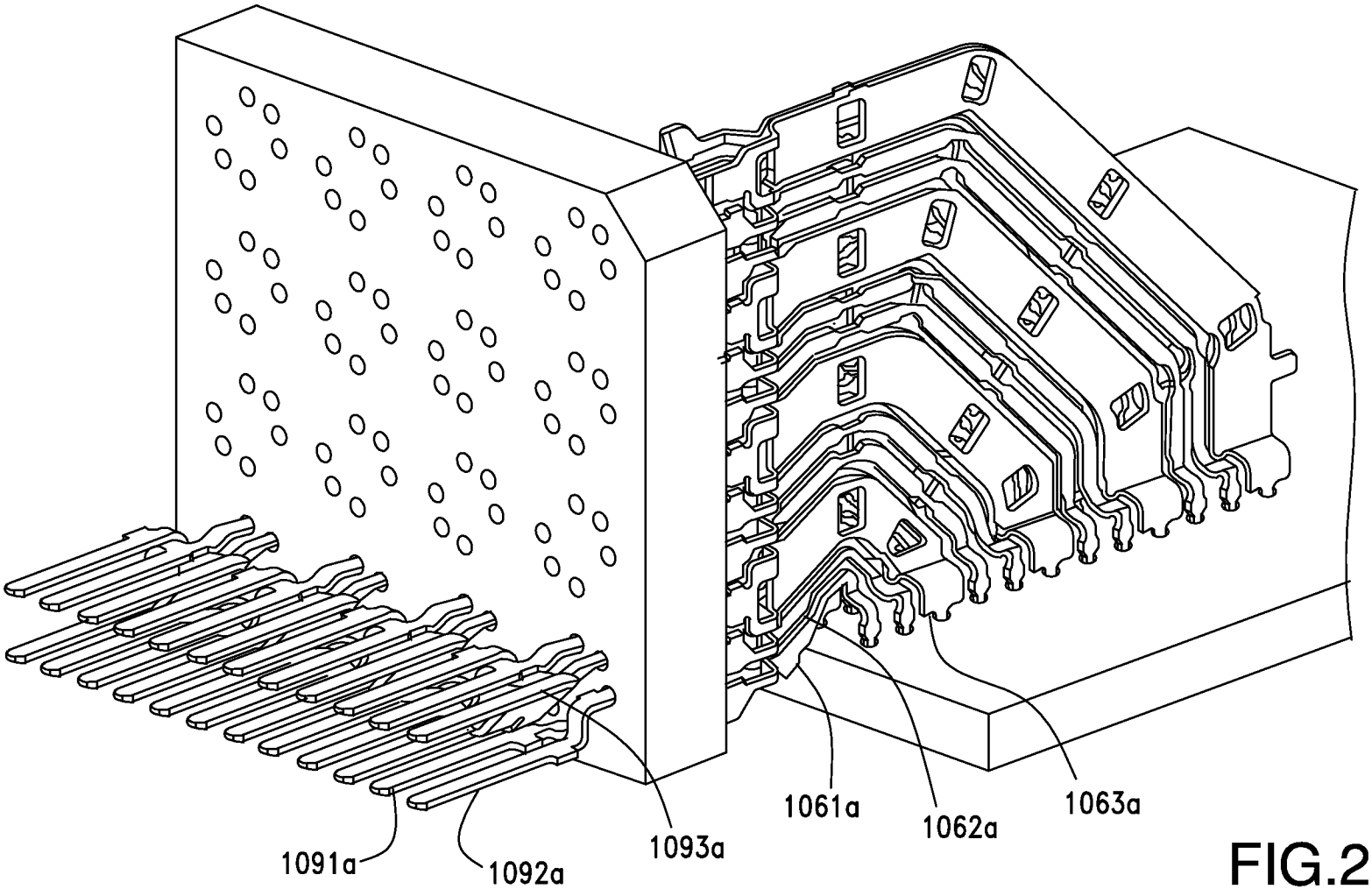
FIG. 23 illustrates a perspective view of the embodiment depicted in FIG. 21*a* with a different set of terminals.
Figure 24:
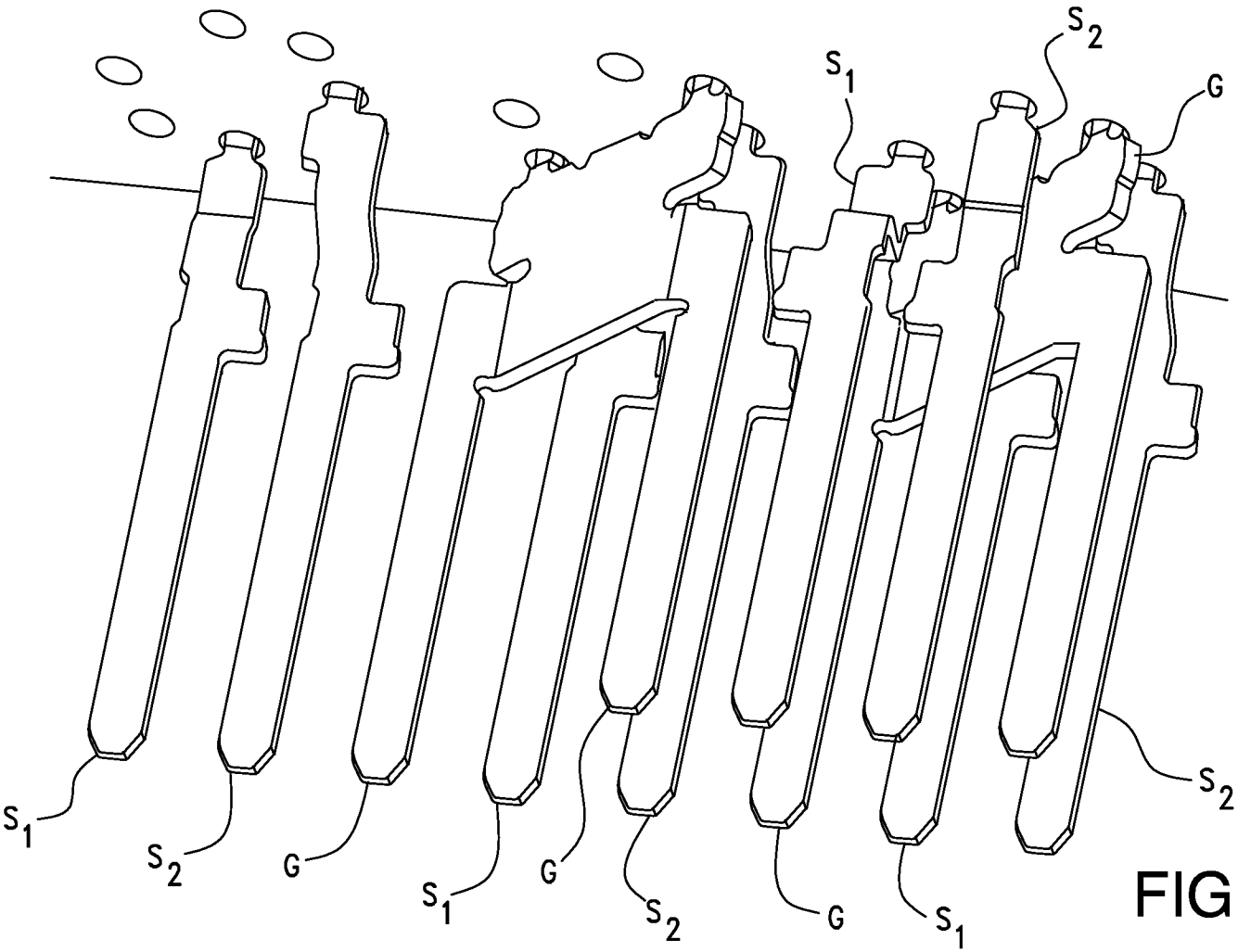
FIG. 24 illustrates a perspective view of an embodiment of a plurality of terminals.
Figure 25:
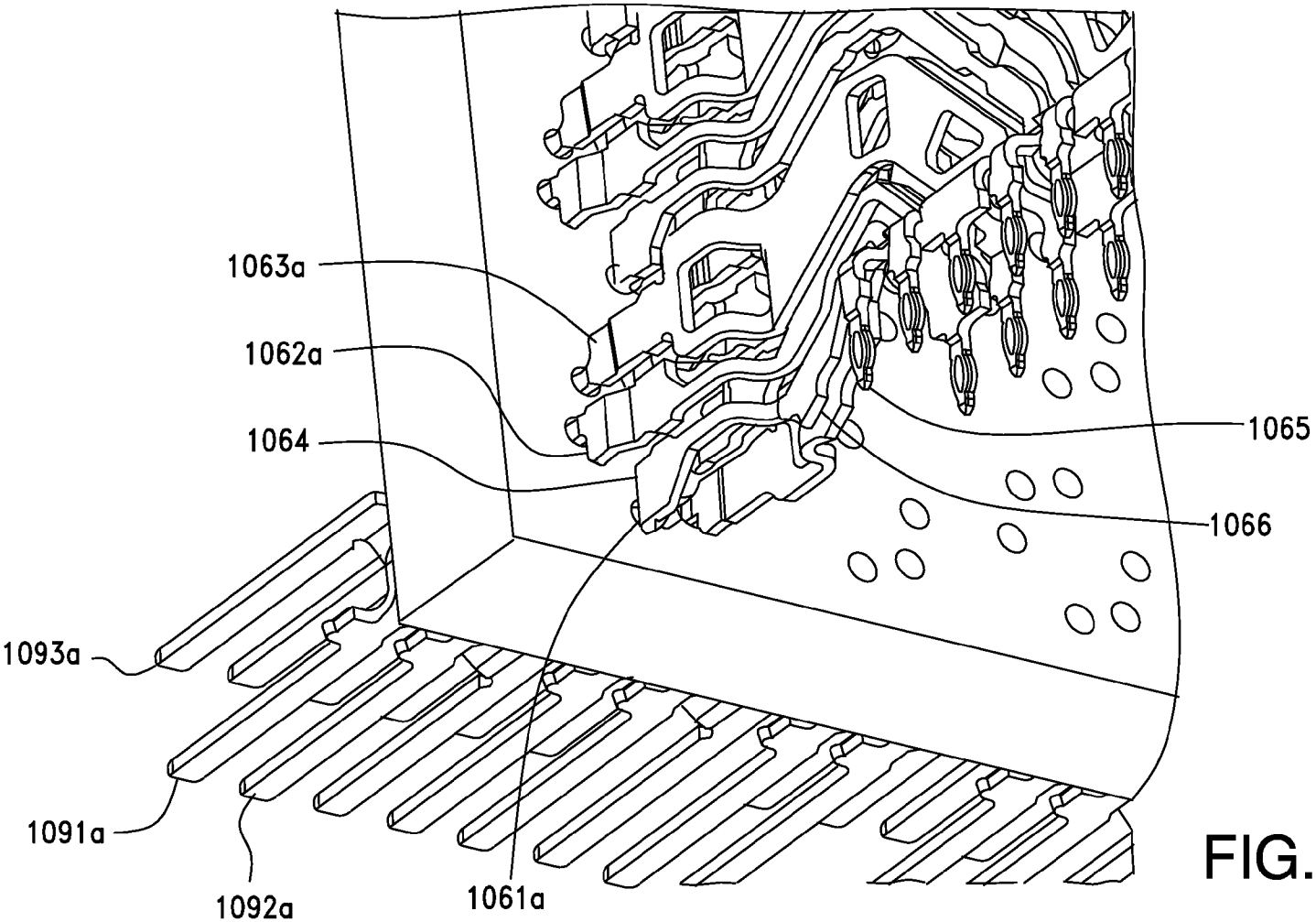
FIG. 25 illustrates a perspective enlarged view of the embodiment depicted in FIG. 23.
Figure 26:
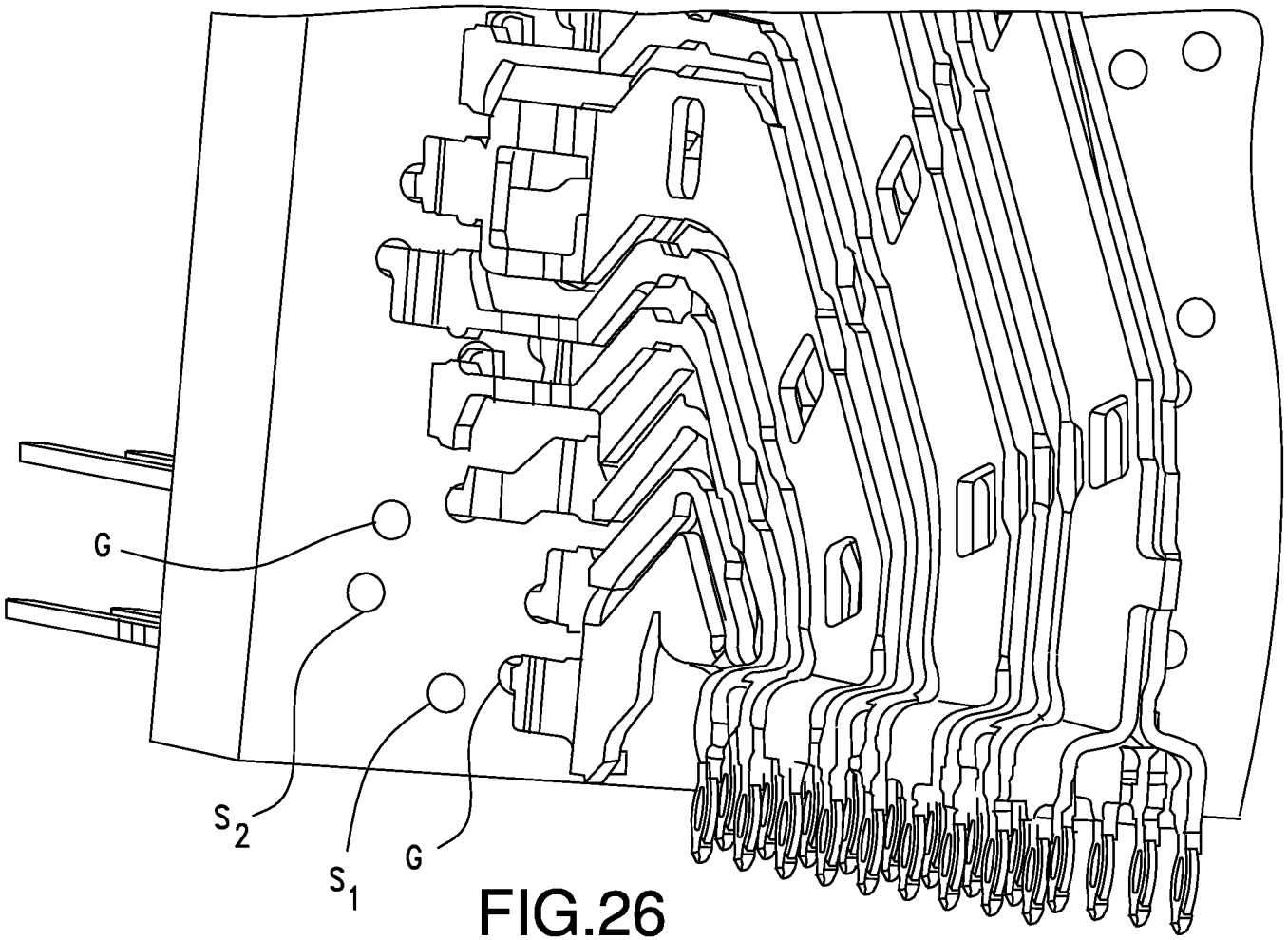
FIG. 26 illustrates another perspective simplified view of the embodiment depicted in FIG. 25.

As can be appreciated from FIGS. 21A and 21B, the terminals and contacts are coupled together via the plated thru-holes 1102 in the coupler 1100. One effect of the design is that two wafers on opposite sides of the coupler 1100 will only share a limited number of signal paths. In the depicted design each wafer will share two signal paths, which has the potential benefit of allowing for a transmit channel and a receive channel to be provided simultaneously. As depicted, a ground contact 1093*a* is coupled to ground terminal 1063*a*, while signal contacts 1091*a*, 1092*b* are coupled respectively to signal terminals 1061*a*, 1062*b*.

Figure 27:
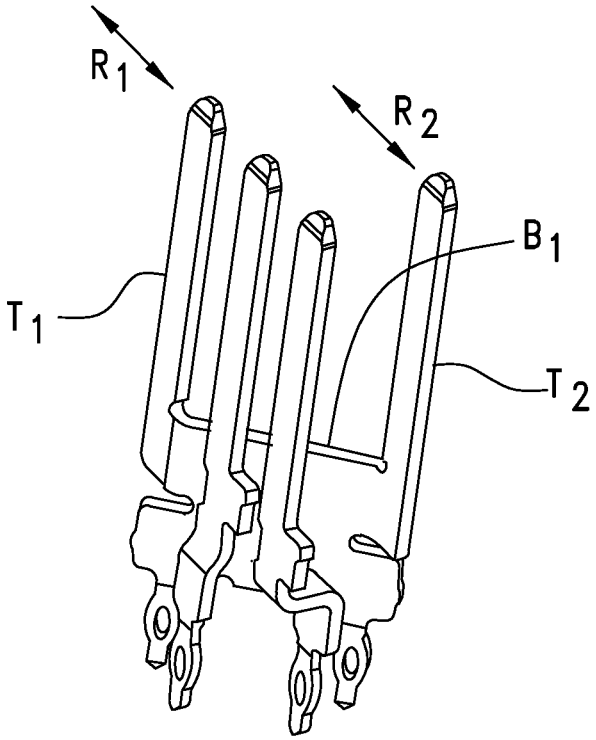
FIG. 27 illustrates a perspective view of a plurality of terminals.
Figure 28:
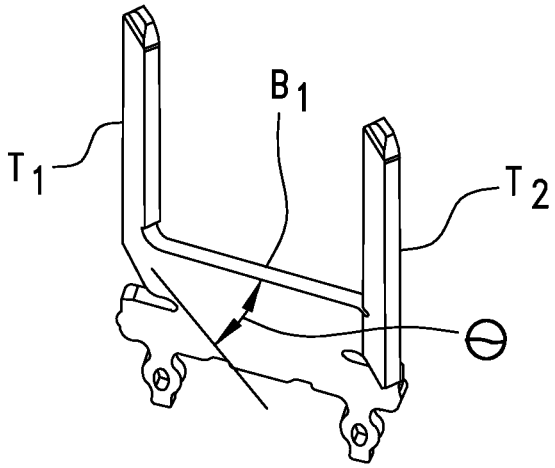
FIG. 28 illustrates a perspective view of a ground terminal.

FIGS. 27 and 28 illustrate features of an exemplary embodiment of contacts and to help provide desirable separation between pairs of signal contacts, a ground contact may include blade T1 and T2 and are joined by body B1, which extends between the two blades. As depicted, the blades T1 and T2 are aligned in two rows R1, and R2 and the body B1 extends between the two rows but at an angle Ø compared to the row R1. In an embodiment, the angle Ø may be about 45 degrees.

To support the contacts, the wall 1084 includes contact channels 1088, which may include signal contact channels 1088*a* and ground contact channels 1088*b*. As can be appreciated, if the ground terminals include the body B1, then the ground contact channel 1088*b* will include a corresponding design.

Figure 30:
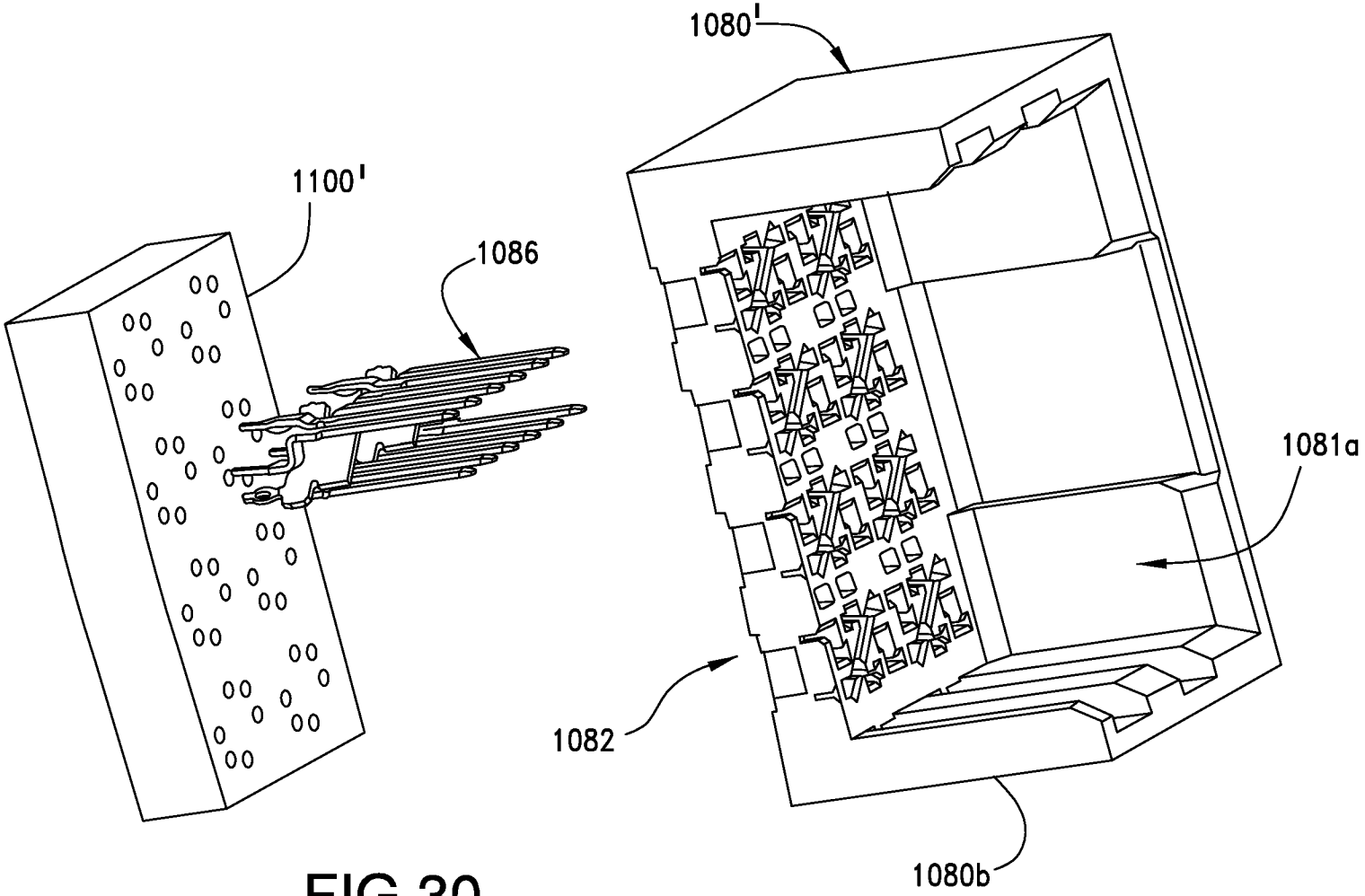
FIG. 30 illustrates an exploded perspective view of another embodiment similar to the embodiment depicted in FIG. 29C.

It should be further noted that in another embodiment, a conventional pin-header 1080', as illustrated by the exploded cross-section depicted in FIG. 30, can be mounted to a circuit board such as a midplane in a traditional manner while still providing the illustrated ground terminal with the two blades T1, T2 positioned in two different rows and coupled by the body B1 so as to provide a ground contact with a goal-post shape. The body helps provide additional electrical isolation between pairs of signal terminals in the transition region that is otherwise difficult to control and therefore can help reduce cross-talk.

The disclosure provided herein describes features in terms of preferred and exemplary embodiments thereof. Numerous other embodiments, modifications and variations within the scope and spirit of the appended claims will occur to persons of ordinary skill in the art from a review of this disclosure.

We claim:

1. An adaptor, comprising:

a housing with a perimeter wall with a first and second edge and a floor positioned between the first and second edge and having a first and second side, the perimeter wall and the floor defining a first and second recess; and a terminal array supported by the floor, the terminal array including a first and second signal terminal and a ground terminal, the signal terminals including first contact ends and second contact ends, the first contact ends extending from the first side and positioned in the first recess and the second contact ends extending from the second side and positioned in the second recess, the first contact ends positioned in a first row and the second contact ends positioned in a second row, the first and second row being perpendicular to each other.

2. The adaptor of claim 1, wherein the perimeter wall has four sides.

3. The adaptor of claim 2, wherein the first contact ends are orientated in a first direction in the first row and the second contact ends are orientated in a second direction in the second row, the first and second direction being perpendicular to each other.

4. The adaptor of claim 3, wherein the terminal array is a first terminal array and the ground terminal is a first ground terminal and the second recess is smaller than the first recess, the adaptor further comprising a second terminal array supported by the floor, the second pin array including a third and fourth signal terminal and a second ground terminal, the terminals of the second pin array including first contact ends extending from the first side of the floor and positioned in the first recess and tails extending from the second side of the floor, the tails not positioned in the second recess.

5. The adaptor of claim 1, wherein the terminal array further includes a fourth, fifth and sixth terminal each with first contact end in a third row, the third row parallel to the first row and positioned in the first recess, the fourth and firth terminal being signal terminals and the sixth terminal being a ground terminal, each of the first, second, third, fourth, fifth and sixth terminals being distinct from each other.

6. The adaptor of claim 5, further comprising a commoning bar positioned in the floor, the commoning bar electrically coupling the third and sixth terminal.

7. An adaptor, comprising:

a housing with a perimeter wall with a first and second edge and a floor positioned between the first and second edge, the floor having a first and second side, the perimeter wall and the first side of the floor defining a first recess and the perimeter wall and the second side defining a second recess, wherein the first recess is larger than the second recess;

a first pin array supported by the floor, the first pin array including a first and second signal terminal and a first ground terminal, the first and second signal terminals each including first contact ends and second contact ends, the first contact ends positioned in the first recess and the second contact ends positioned in the second recess, the first contact ends positioned in a first row and the second contact ends positioned in a second row, the first and second row being perpendicular to each other; and a second pin array supported by the floor, the second pin array including a third and fourth signal terminal and a second ground terminal, the terminals of the second pin array including first contact ends extending from the first side of the floor and positioned in the first recess and tails extending from the second side of the floor, the tails not positioned in the second recess.

8. The adaptor of claim 7, wherein the perimeter wall is rectangular in shape.

9. The adaptor of claim 7, wherein the housing further includes a flange extending out from the perimeter wall, the flange positioned between the first and second edge.

10. The adaptor of claim 7, wherein the first contact ends are orientated in a first direction in the first row and the second contact ends are orientated in a second direction in the second row, the first and second direction being perpendicular to each other.

* * * * *